US007718882B2

(12) United States Patent
Devalapalli et al.

(10) Patent No.: US 7,718,882 B2
(45) Date of Patent: May 18, 2010

(54) EFFICIENT IDENTIFICATION OF SETS OF AUDIO PARAMETERS

(75) Inventors: Suresh Devalapalli, San Diego, CA (US); Prajakt Kulkarni, San Diego, CA (US); Nidish Ramachandra Kamath, Placentia, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 12/042,121

(22) Filed: Mar. 4, 2008

(65) Prior Publication Data

US 2008/0229916 A1 Sep. 25, 2008

Related U.S. Application Data

(60) Provisional application No. 60/896,446, filed on Mar. 22, 2007.

(51) Int. Cl.
*G10H 1/00* (2006.01)

(52) U.S. Cl. ..... 84/604; 84/609; 84/649

(58) Field of Classification Search ..... 84/604–607, 84/609, 618, 649–650, 656
See application file for complete search history.

(56) References Cited

U.S. PATENT DOCUMENTS 5,596,159 A * 1/1997 O'Connell ..... 84/622
5,852,251 A * 12/1998 Su et al. ..... 84/645
5,864,080 A * 1/1999 O'Connell ..... 84/622
5,880,386 A * 3/1999 Wachi et al. ..... 84/601
6,459,030 B1 * 10/2002 Di Paolo et al. ..... 84/620
7,045,700 B2 * 5/2006 Hamalainen et al. ..... 84/645
7,105,737 B2 * 9/2006 Frangopol et al. ..... 84/615
7,158,530 B2 * 1/2007 Tsunoda et al. ..... 370/432
7,378,587 B2 * 5/2008 Chang ..... 84/609
2004/0159219 A1 * 8/2004 Holm et al. ..... 84/645
2004/0209629 A1 * 10/2004 Virolainen et al. ..... 455/466
2004/0267541 A1 * 12/2004 Hamalainen et al. ..... 704/278
2005/0257669 A1 * 11/2005 Frangopol et al. ..... 84/615
2006/0123981 A1 * 6/2006 Chang ..... 84/645

(Continued)

FOREIGN PATENT DOCUMENTS

DE 102005052312 6/2006

OTHER PUBLICATIONS

International Search Report, PCT/US08/057246, International Search Authority, European Patent Office, Jul. 14, 2008.

(Continued)

*Primary Examiner*—David S. Warren
(74) *Attorney, Agent, or Firm*—Todd E. Marlette; Espartaco Diaz Hidalgo

(57) ABSTRACT

Techniques are described of efficiently identifying sets of audio parameters to be applied during a time frame. For example, a list of indicators may be generated. Each of the indicators in the list may indicate a Musical Instrument Digital Interface (MIDI) voice present in a MIDI frame. Furthermore, in generating the list, the indicators in the list may be restricted to those indicators that indicate the most acoustically significant MIDI voices in the MIDI frame. After the list is generated, a digital waveform may be generated for each of MIDI voices indicated by an indicator in the list. A combination of the waveforms of each MIDI voice may constitute an overall waveform for the MIDI frame.

40 Claims, 13 Drawing Sheets

U.S. PATENT DOCUMENTS

2008/0250913 A1* 10/2008 Gerrits et al. ..... 84/604

OTHER PUBLICATIONS

Written Opinion, PCT/US08/057246, International Search Authority, European Patent Office, Jul. 14, 2008.

Mauchly, "Merging Event Lists in Real-Time," Proceedings, 2nd Symposium on Small Computers in the Arts. Oct. 15-17, 1982. pp. 23-28, IEEE, Philadelphia, PA, USA, XP009102017.

Roads, "The Computer Music Tutorial," MIT Press, 1996, pp. 675-677, Cambridge, MA, USA, XP002485635.

* cited by examiner

EFFICIENT IDENTIFICATION OF SETS OF AUDIO PARAMETERS

RELATED APPLICATIONS

Claim of Priority under 35 U.S.C. §119

The present Application for Patent claims priority to Provisional Application No. 60/896,446 entitled "EFFICIENT IDENTIFICATION OF SETS OF AUDIO PARAMETERS" filed Mar. 22, 2007, and assigned to the assignee hereof and hereby expressly incorporated by reference herein.

Reference to Co-Pending Applications for Patent

The present Application for Patent is related to the following co-pending U.S. patent applications:

"MUSICAL INSTRUMENT DIGITAL INTERFACE HARDWARE INSTRUCTIONS", filed concurrently herewith, assigned to the assignee hereof.

TECHNICAL FIELD

This disclosure relates to electronic devices, and particularly to electronic devices that generate audio.

BACKGROUND

Musical Instrument Digital Interface (MIDI) is a format for the creation, communication, and playback of audio sounds, such as music, speech, tones, alerts, and the like. A device that supports the MIDI format may store sets of audio information that can be used to create various "voices." Each voice may correspond to a particular sound, such as a musical note by a particular instrument. For example, a first voice may correspond to a middle C as played by a piano, a second voice may correspond to a middle C as played by a trombone, a third voice may correspond to a D♯ as played by a trombone, and so on. In order to replicate the sounds of different instruments, a MIDI-compliant device may include a set of information for voices that specify various audio characteristics associated with the sounds, such as the behavior of a low-frequency oscillator, effects such as vibrato, and a number of other audio characteristics that can affect the perception of sound. Almost any sound can be defined, conveyed in a MIDI file, and reproduced by a device that supports the MIDI format.

A device that supports the MIDI format may produce a musical note (or other sound) when an event occurs that indicates that the device should start producing the note. Similarly, the device stops producing the musical note when an event occurs that indicates that the device should stop producing the note. An entire musical composition may be coded in accordance with the MIDI format by specifying events that indicate when certain voices should start and stop and various effects on the voices. In this way, the musical composition may be stored and transmitted in a compact file format according to the MIDI format.

The MIDI format is supported in a wide variety of devices. For example, wireless communication devices, such as radiotelephones, may support MIDI files for downloadable sounds such as ringtones or other audio output. Digital music players, such as the "iPod" devices sold by Apple Computer, Inc and the "Zune" devices sold by Microsoft Corp. may also support MIDI file formats. Other devices that support the MIDI format may include various music synthesizers such as keyboards, sequencers, voice encoders (vocoders), and rhythm machines. In addition, a wide variety of devices may also support playback of MIDI files or tracks, including wireless mobile devices, direct two-way communication devices (sometimes called walkie-talkies), network telephones, personal computers, desktop and laptop computers, workstations, satellite radio devices, intercom devices, radio broadcasting devices, hand-held gaming devices, circuit boards installed in devices, information kiosks, video game consoles, various computerized toys for children, on-board computers used in automobiles, watercraft and aircraft, and a wide variety of other devices.

SUMMARY

In general, techniques are described of efficiently identifying sets of audio parameters to be applied during a time frame. For example, a list of indicators may be generated. Each of the indicators in the list may indicate a Musical Instrument Digital Interface (MIDI) voice present in a MIDI frame. Furthermore, in generating the list, the indicators in the list may be restricted to those indicators that indicate the most acoustically significant MIDI voices in the MIDI frame. After the list is generated, a digital waveform may be generated for each of MIDI voices indicated by an indicator in the list. A combination of the waveforms of each MIDI voice may constitute an overall waveform for the MIDI frame.

In one aspect, a method comprises generating a linked list of voice indicators. Each of the voice indicators in the linked list indicates a Musical Instrument Digital Interface (MIDI) voice for a MIDI frame by specifying a memory location that stores a voice parameter set that defines the MIDI voice. The MIDI voices indicated by the voice indicators in the linked list are those MIDI voices that have the greatest acoustical significance during the MIDI frame. The method also comprises generating digital waveforms for MIDI voices indicated by the voice indicators in the linked list.

In another aspect, a device comprises a memory unit that stores voice parameter sets, wherein each of the voice parameter sets defines a Musical Instrument Digital Interface (MIDI) voice. The device also comprises a coordination module that generates a linked list of voice indicators. Each of the voice indicators in the linked list indicates a MIDI voice by specifying a memory location in the memory unit that stores one of the voice parameter sets the defines the MIDI voice. MIDI voices indicated by the voice indicators in the linked list are those MIDI voices that have the greatest acoustical significance during the MIDI during the MIDI frame. The device also comprises a plurality of processing elements that generate digital waveforms of MIDI voices indicated by the voice indicators in the linked list.

In another aspect, a computer-readable medium comprises instructions that cause a programmable processor to generate a linked list of voice indicators. Each of the voice indicators in the linked list indicates a Musical Instrument Digital Interface (MIDI) voice for a MIDI frame by specifying a memory location that stores a voice parameter set that defines the MIDI voice. The MIDI voices indicated by the voice indicators in the linked list are those MIDI voices that have the greatest acoustical significance during the MIDI frame. The computer-readable medium also comprises instructions for causing the processor to generate digital waveforms MIDI voices indicated by the voice indicators in the linked list.

In another aspect, a device comprises a means for storing voice parameter sets. Each of the voice parameter sets defines a Musical Instrument Digital Interface (MIDI) voice. The device also comprises a means for generating a linked list of voice indicators. Each of the voice indicators in the linked list indicates a MIDI voice by specifying a memory location in the memory unit that stores one of the voice parameter sets the defines the MIDI voice. MIDI voices indicated by the voice indicators in the linked list are those MIDI voices that have the greatest acoustical significance during the MIDI during the MIDI frame. The device also comprises a plurality of processing means for generating digital waveforms of MIDI voices indicated by the voice indicators in the linked list.

In another aspect, a circuit may be configured to generate a linked list of voice indicators, wherein each of the voice indicators in the linked list indicates a MIDI voice for a MIDI frame by specifying a memory location that stores a voice parameter set that defines the MIDI voice, and wherein the MIDI voices indicated by the voice indicators in the linked list are those MIDI voices that have a greatest acoustical significance during the MIDI frame. The circuit may also be configured to generate digital waveforms for the MIDI voices indicated by the voice indicators in the linked list.

The details are set forth in the accompanying drawings and the description below. Other features, objects, and advantages will be apparent from the description and drawings, and from the claims.

DETAILED DESCRIPTION

This disclosure describes techniques of generating a digital waveform for a Musical Instrument Digital Interface (MIDI) voice using a set of machine-code instructions that is specialized for the generation of digital waveforms for MIDI voices. For example, a processor may execute a software program that generates a digital waveform for a MIDI voice. The instructions of the software program may be machine code instructions from an instruction set that is specialized for the generation of digital waveforms for MIDI voices.

Figure 1:
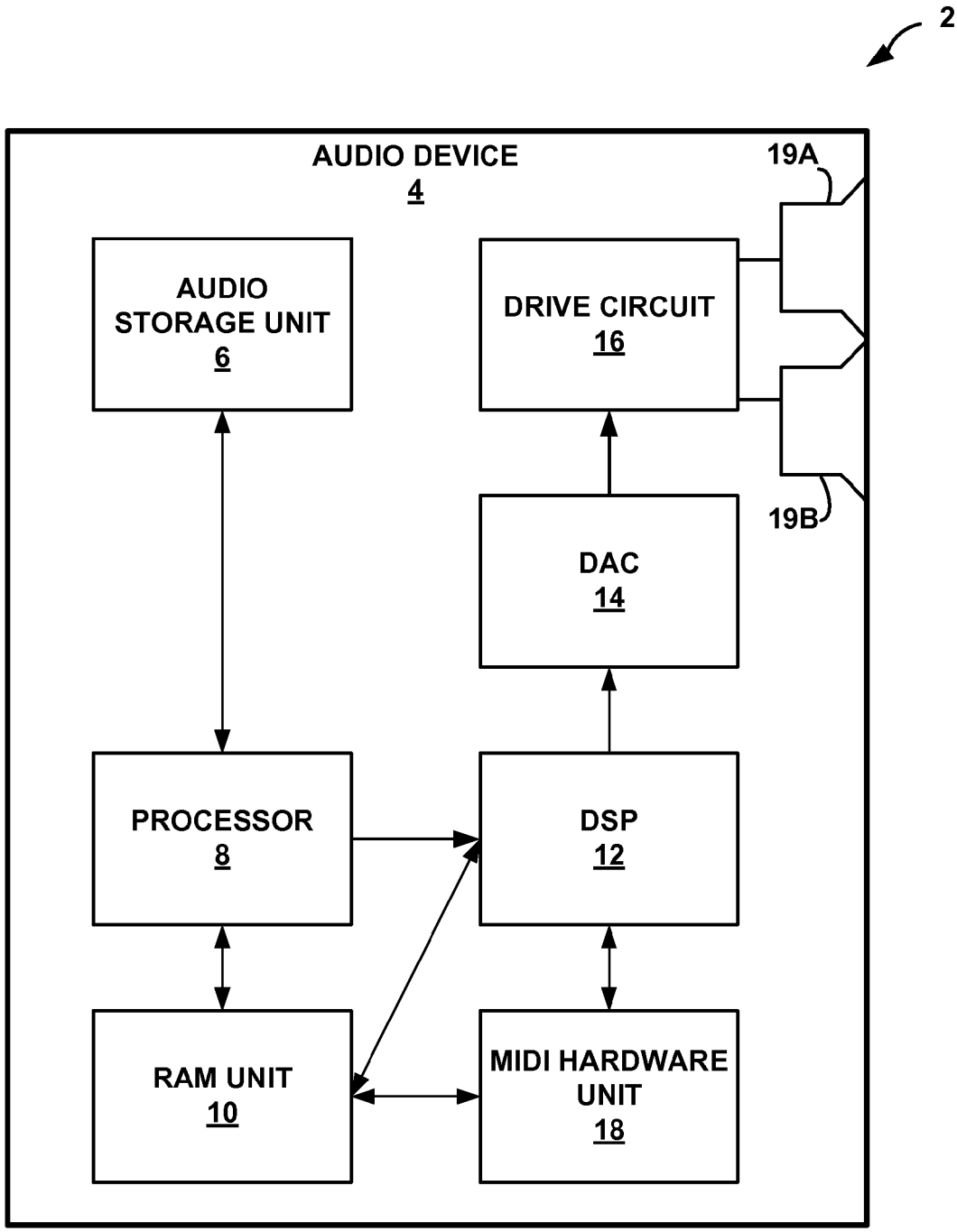
FIG. 1 is a block diagram illustrating an exemplary system that includes an audio device that generates sound.

FIG. 1 is a block diagram illustrating an exemplary system 2 that includes an audio device 4 that generates sound. Audio device 4 may be one of several different types of devices. For instance, audio device 4 may be a mobile telephone, a network telephone, a personal computer, a direct two-way communication device (sometimes called a walkie-talkie), a personal computer, a desktop or laptop computer, a workstation, a satellite radio device, an intercom device, a radio broadcasting device, a handheld gaming device, a circuit board installed in a device such as a kiosk, various computerized toys for children, on-board computers used in automobiles, watercraft, aircraft, spacecraft, or other type of device. Digital music players, such as the "iPod" devices sold by Apple Computer, Inc and the "Zune" devices sold by Microsoft Corp. may also support MIDI file formats. Other devices that support the MIDI format may include various music synthesizers such as keyboards, sequencers, voice encoders (vocoders), and rhythm machines.

The various components illustrated in FIG. 1 are those needed to explain aspects of this disclosure. However, other components may exist and some of the illustrated components may not be included in some implementations. For example, if audio device 4 is a radiotelephone, an antenna, transmitter, receiver and modem (modulator-demodulator) may be included to facilitate wireless communication of audio files.

As illustrated in the example of FIG. 1, audio device 4 includes an audio storage unit 6 that stores MIDI files. Audio storage unit 6 may comprise any volatile or non-volatile memory or storage. For example, audio storage unit 6 may be a hard disk drive, a flash memory unit, a compact disc, a floppy disk, a digital versatile disc, a read-only memory unit, a random-access memory, or information storage medium. Audio storage unit 6 may store Musical Instrument Device Interface (MIDI) files and other types of data. For example, if audio device 4 is a mobile telephone, audio storage unit 6 may store data that comprises a list of personal contacts, photographs, and other types of data.

Audio device 4 also includes a processor 8 that may read data from and write data to audio storage unit 6. Furthermore, processor 8 may read data from and write data to a Random Access Memory (RAM) unit 10. For example, processor 8 may read a portion of a MIDI file from audio storage module 6 and write that portion of the MIDI file to RAM unit 10. Processor 8 may comprise a general purpose microprocessor, such as an Intel Pentium 4 processor, an embedded microprocessor conforming to an ARM architecture by ARM Holdings of Cherry Hinton, UK, or other type of general purpose processor. RAM unit 10 may comprise one or more static or dynamic RAM units.

After processor 8 reads a MIDI file, processor 8 may parse MIDI files and schedule MIDI events associated with the MIDI files. For example, for each MIDI frame, processor 8 may read one or more MIDI files and may extract MIDI events from the MIDI files. Based on the MIDI instructions, processor 8 may schedule the MIDI events for processing by DSP 12. After scheduling the MIDI events, processor 8 may provide the scheduling to RAM unit 10 or DSP 12 so that DSP 12 can process the events. Alternatively, processor 8 may execute the scheduling by dispatching the MIDI events to DSP 12 in the time-synchronized manner. DSP 12 may service the scheduled events in a synchronized manner, as specified by timing parameters in the MIDI files. The MIDI events may include channel voice messages that are used to send musical performance information. Channel voice messages may include instruction to turn a particular MIDI voice on or off, change polyphonic key pressure, channel pressure, pitch bend change, control change messages, aftertouch effects, breath-control effects, program changes, pitch bend effects, pan left or right, sustain pedal, main volume, sostenuto, and other channel voice messages. In addition, the MIDI events may include channel mode messages that affect the way a MIDI device responds to MIDI data. Furthermore, the MIDI events may include system messages such as system common messages that are intended for all receivers in a MIDI system, system real-time messages that are used for synchronization between clock-based MIDI components, and other system-related messages. The MIDI events may also be MIDI show control messages (e.g., lighting effect cues, slide projection cues, machinery effect cues, pyrotechnical cues, and other effect cues).

When DSP 12 receives MIDI instructions from processor 8, DSP 12 may process the MIDI instructions to generate a continuous pulse-code modulation (PCM) signal. The PCM signal is a digital representation of an analog signal in which a waveform is represented by digital samples at regular intervals. DSP 12 may output this PCM signal to a Digital to Analog Converter (DAC) 14. DAC 14 may convert this digital waveform into an analog signal. A drive circuit 18 may use the analog signal to drive speakers 19A and 19B for output of physical sound to a user. The disclosure refers to speakers 19A and 19B collectively as "speakers 19." Audio device 4 may include one or more additional components (not shown) including filters, pre-amplifiers, amplifiers, and other types of components that prepare the analog signal for eventual output by speakers 19. In this way, audio device 4 may generate sounds in accordance with a MIDI file.

In order to generate a digital waveform, DSP 12 may use a MIDI hardware unit 18 that generates a digital waveform for an individual MIDI frame. Each MIDI frame may correspond to 10 milliseconds, or another time interval. When a MIDI frame corresponds to 10 milliseconds, and the digital waveform is sampled at 48 kHz (i.e., 48,000 samples per second), there are 480 samples in each MIDI frame. MIDI hardware unit 18 may be implemented as a hardware component of audio device 4. For example, MIDI hardware unit 18 may be a chipset embedded into a circuit board of audio device 4. To use MIDI hardware unit 18, DSP 12 may first determine whether MIDI hardware unit 18 is idle. MIDI hardware unit 18 may be idle after MIDI hardware unit 18 finishes generating a digital waveform for a MIDI frame. DSP 12 may then generate a list of voice indicators that indicate MIDI voices present in the MIDI frame. After DSP 12 generates the list of voice indicators, DSP 12 may set one or more registers in MIDI hardware unit 18. DSP 12 may use direct memory exchange (DME) to set these registers. DME is a procedure that transfers data from one memory unit to another memory unit while a processor is performing other operations. After DSP 12 sets the registers, DSP 12 may instruct MIDI hardware unit 18 to begin generating the digital waveform for the MIDI frame. As explained in detail below, MIDI hardware unit 18 may generate the digital waveform for the MIDI frame by generating a digital waveform for each of the MIDI voice in the list of voice indicators and aggregating these digital waveforms into the waveform for the MIDI voice. When MIDI hardware unit 18 finishes generating the digital waveform for the MIDI frame, MIDI hardware unit 18 may send an interrupt to DSP 12. Upon receiving the interrupt from MIDI hardware unit 18, DSP 12 may send a DME request for the digital waveform to MIDI hardware unit 18. When MIDI hardware unit 18 receives the request, MIDI hardware unit 18 may send the digital waveform to DSP 12.

To generate the list of voice indicators that indicate MIDI voices present in a MIDI frame, DSP 12 may determine which of the MIDI voices has at least a minimum level of acoustical significance in the MIDI frame. The level of acoustical significance of a MIDI voice in a MIDI frame may be a function of the importance of that MIDI voice to the overall sound perceived by a human listener of the MIDI frame.

To generate a digital waveform for a MIDI voice, MIDI hardware unit 18 may access at least some voice parameters in a voice parameter set that defines the MIDI voice. A set of voice parameters may define a MIDI voice by specifying information necessary to generate a digital waveform for a MIDI voice and/or by specifying where such information may be located. For example, a set of MIDI voice parameters may specify a level of resonance, pitch reverberation, volume, and other acoustic characteristics. In addition, a set of MIDI voice parameters includes a pointer to an address of location in RAM unit 10 that contains a base waveform of the voice. The digital waveform for the MIDI frame may be the aggregation of the digital waveforms of the MIDI voices. For example, the digital waveform for the MIDI frame may be the sum of the digital waveforms of the MIDI voices.

As will be discussed in detail below, MIDI hardware unit 18 may provide several advantages. For instance, MIDI hardware unit 18 may include several features that result in efficient generation of digital waveforms. As a result of this efficient generation of digital waveforms, audio device 4 may be able to produce higher quality sound, consume less power, or otherwise improve upon conventional techniques for playback of MIDI files. Moreover, because MIDI hardware unit 18 may efficiently generate digital waveforms, MIDI hardware unit 18 may be able to generate digital waveforms for more MIDI voices within a fixed amount of time. The presence of such additional MIDI voices may improve the quality of a sound perceived by a human listener.

Figure 2:
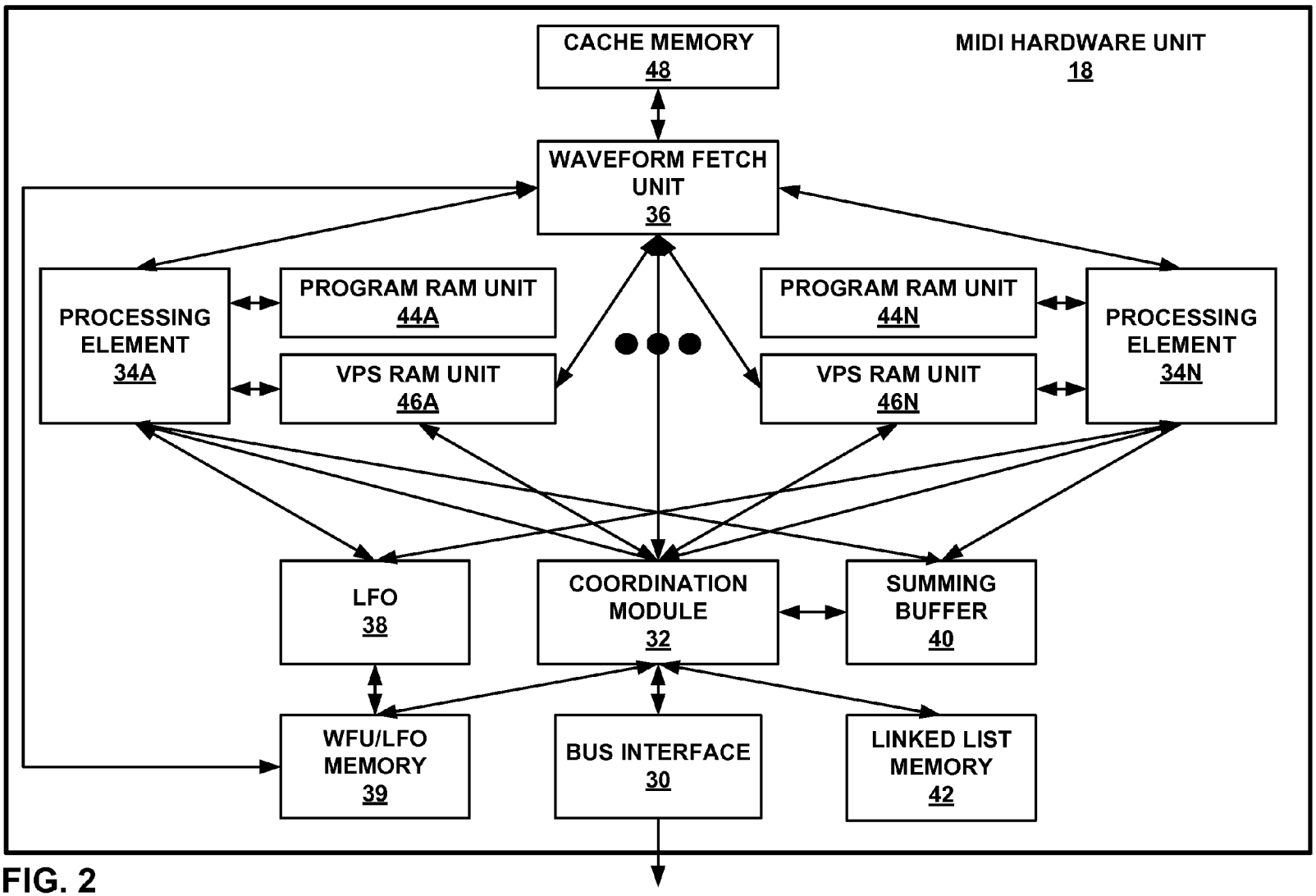
FIG. 2 is a block diagram illustrating an exemplary Musical Instruments Device Interface (MIDI) hardware unit of the audio device.

FIG. 2 is a block diagram illustrating an exemplary MIDI hardware unit 18 of audio device 4. As illustrated in the example of FIG. 2, MIDI hardware unit 18 includes a bus interface 30 that sends and receives data. For example, bus interface 30 may include an AMBA High-performance Bus (AHB) master interface, an AHB slave interface, and a memory bus interface. Alternatively, bus interface 30 may include an AXI bus interface, or another type of bus interface. AXI stands for advanced extensible interface.

In addition, MIDI hardware unit 18 may include a coordination module 32. Coordination module 32 coordinates data flows within MIDI hardware unit 18. When MIDI hardware unit 18 receives an instruction from DSP 12 to begin generating a digital signal for a MIDI frame, coordination module 32 may load a list of voice indicators generated by DSP 12 from RAM unit 10 into a linked list memory unit 42 in MIDI hardware unit 18. Each voice indicator in the list indicates a MIDI voice that has acoustical significance during the current MIDI frame. Each voice indicator in the list of voice indicators may specify a memory location in RAM unit 10 that stores a voice parameter set that defines a MIDI voice. For example, each voice indicator may include a memory address of a particular voice parameter set or an index value from which coordination module 32 may derive a memory address of a particular voice parameter set.

After coordination module 32 loads the list of voice indicators into linked list memory unit 42, coordination module 32 may identify one of processing elements 34A through 34N to generate a digital waveform for one of the MIDI voices indicated by a voice indicator in the list of voice indicators stored in linked list memory 42. Processing elements 34A through 34N are collectively referred to herein as "processing elements 34." Processing elements 34 may generate digital waveforms for MIDI voices in parallel with one another.

Each of processing elements 34 may be associated with one of voice parameter set (VPS) RAM units 46A through 46N. This disclosure may collectively refer to VPS RAM units 46A through 46N as "VPS RAM units 46." VPS RAM units 46 may be registers that store voice parameters that are used by processing elements 34. When coordination module 32 identifies one of processing elements 34 to generate a digital waveform for a MIDI voice, coordination module 32 may store voice parameters of a voice parameter set of the MIDI voice into the one of VPS RAM units 46 associated with the identified processing element. In addition, coordination module 32 may store voice parameters of the voice parameter set into a waveform fetch unit/low-frequency oscillator (WFU/LFO) memory unit 39.

After loading the voice parameters into the VPS RAM unit and WFU/LFO memory unit 39, coordination module 32 may instruct the processing element to begin generate a digital waveform for the MIDI voice. Each of processing elements 34 may be associated with one of program memory units 44A through 44N (collectively, "program memory units 44"). Each of program memory units 44 stores a set of program instructions. To generate a digital waveform for a MIDI voice, the processing element may execute the set of program instructions stored in the one of program memory units 44 associated with the processing element. These program instructions may cause the processing element to retrieve a set of voice parameters from the one of VPS memory units 46 associated with the processing element. In addition, the program instructions may cause the processing element to send a request to a waveform fetch unit (WFU) 36 for a waveform specified in the voice parameters by a pointer to a base waveform sample for the voice. Each of processing elements 34 may use WFU 36. In response to the request from one of processing elements 34, WFU 36 may return one or more waveform samples to the requesting processing element. Because a waveform may be phase shifted within a sample, e.g., by up to one cycle of the waveform, WFU 36 may return two samples in order to compensate for the phase shifting using interpolation. Furthermore, because a stereo signal consists of two separate waveforms, WFU 36 may return up to four samples. The last sample returned by WFU 36 may be a fractional phase which may be used for interpolation. WFU 36 may use a cache memory 48 to fetch base waveforms faster.

After WFU 36 returns audio samples to one of processing elements 34, the respective processing element may execute additional program instructions. Such additional instructions may include requesting samples of an asymmetric triangular waveform from a low frequency oscillator (LFO) 38 in MIDI hardware unit 18. By multiplying a waveform returned by WFU 36 with a triangular wave returned by LFO 38, the processing element may manipulate various acoustic characteristics of the waveform. For example, multiplying a waveform by a triangular wave may result in a waveform that sounds more like a desired instrument. Other instructions may cause the processing element to loop the waveform a specific number of times, adjust the amplitude of the waveform, add reverberation, add a vibrato effect, or provide other acoustic effects. In this way, the processing element may generate a waveform for a voice that lasts one MIDI frame. Eventually, the processing element may encounter an exit instruction. When the processing element encounters an exit instruction, the processing element may provide the generated waveform to a summing buffer 40. Alternatively, the processing element may store each sample of the generated digital waveform into summing buffer 40 as the processing element generates such samples.

When summing buffer 40 receives a waveform from one of processing elements 34, the summing buffer aggregates the waveform to an overall waveform for a MIDI frame. For example, summing buffer 40 may initially store a flat waveform (i.e., a waveform where all digital samples are zero.) When summing buffer 40 receives a waveform from one of processing elements 34, summing buffer 40 may add each digital sample of the waveform to respective samples of the waveform stored in summing buffer 40. In this way, summing buffer 40 generates and stores an overall waveform for a MIDI frame.

Eventually, coordination module 32 may determine that processing elements 34 have completed generate a digital waveform for all of the voices indicated in the list in linked list memory 42 and have provided those digital waveforms to summing buffer 40. At this point, summing buffer 40 may contain a completed digital waveform for the entire current MIDI frame. When coordination module 32 makes this determination, coordination module 32 may send an interrupt to DSP 12. In response to the interrupt, DSP 12 may send a request to a control unit in summing buffer 40 (not shown) via direct memory exchange (DME) to receive the content of summing buffer 40. Alternatively, DSP 12 may also be preprogrammed to perform the DME.

Figure 3:
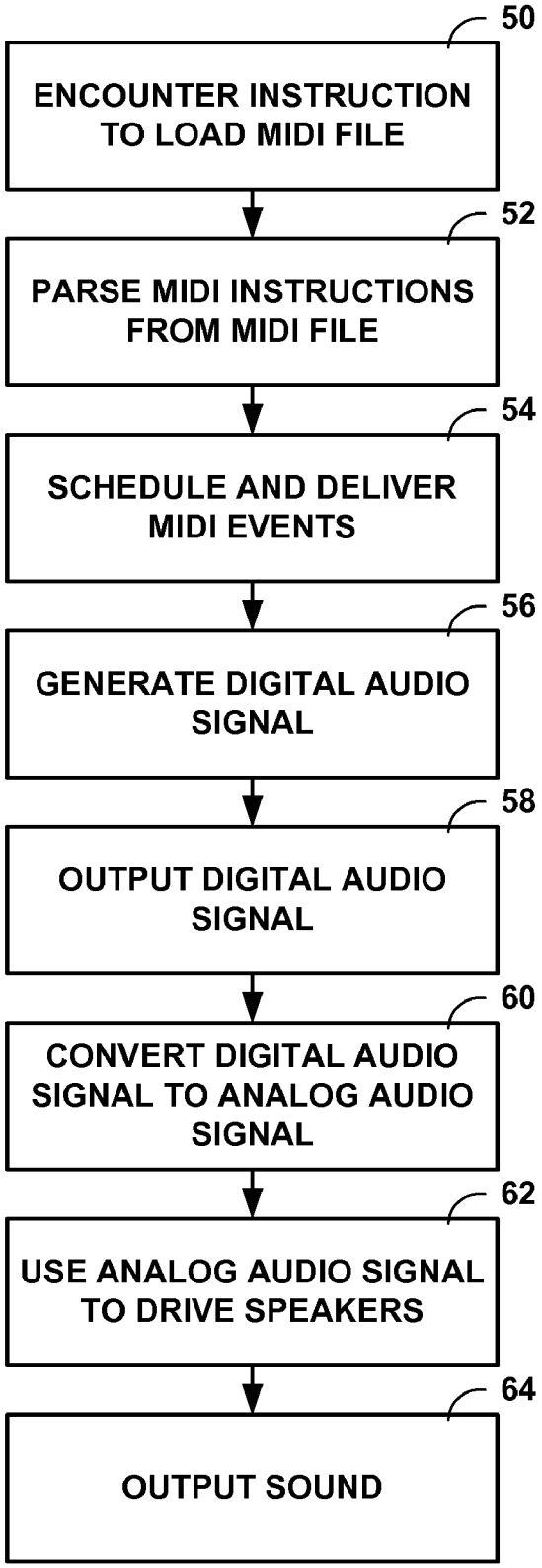
FIG. 3 is a flowchart illustrating an example operation of the audio device.

FIG. 3 is a flowchart illustrating an example operation of audio device 4. Initially, processor 8 encounters a program instruction to load a MIDI file from audio storage module 6 into RAM unit 10 (50). For example, if audio device 4 is a mobile telephone, processor 8 may encounter a program instruction to load a MIDI file from persistent storage module 6 into RAM unit 10 when audio device 4 receives an incoming telephone call and the MIDI file describes a ring tone.

After loading the MIDI file into RAM unit 10, processor 8 may parse MIDI instructions from the MIDI file in RAM unit 10 (52). Processor 8 may then schedule the MIDI events and deliver the MIDI events to DSP 12 according to this schedule (54). In response to the MIDI events, DSP 12, in coordination with MIDI hardware unit 18, may output a continuous digital waveform in real time (56). That is, the digital waveform outputted by DSP 12 is not segmented into discrete MIDI frames. DSP 12 provides the continuous digital waveform to DAC 14 (58). DAC 14 converts individual digital samples in the digital waveform into electrical voltages (60). DAC 14 may be implemented using a variety of different digital-to analog conversion technologies. For example, DAC 14 may be implemented as a pulse width modulator, an oversampling DAC, a weighted binary DAC, an R-2R ladder DAC, a thermometer coded DAC, a segmented DAC, or another type of digital to analog converter.

After DAC 14 converts the digital waveform into an analog audio signal, DAC 14 may provide the analog audio signal to drive circuit 16 (62). Drive circuit 16 may use the analog signal to drive speakers 19 (64). Speakers 19 may be electromechanical transducers that convert the electrical analog signal into physical sound. When speakers 19 produce the sound, a user of audio device 4 may hear the sound and respond appropriately. For example, if audio device 4 is a mobile telephone, the user may answer a phone call when speakers 19 produce a ring tone sound.

Figure 4:
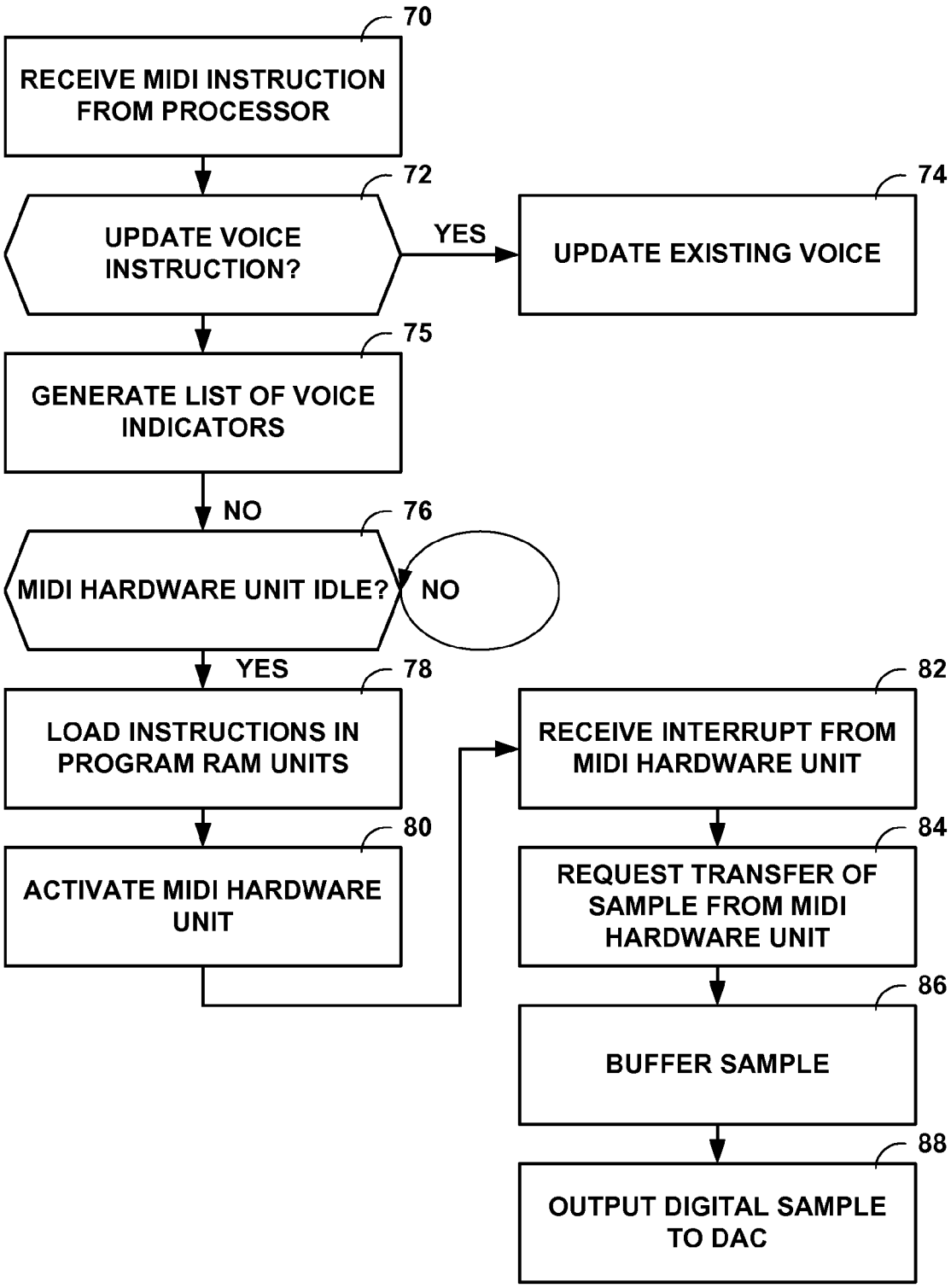
FIG. 4 is a flowchart illustrating an example operation of a Digital Signal Processor (DSP) in the audio device.

FIG. 4 is a flowchart illustrating an example operation of DSP 12 in audio device 4. Initially, DSP 12 receives a MIDI event from processor 8 (70). After receiving the MIDI event, DSP 12 determines whether the MIDI event is an instruction to update a parameter of a MIDI voice (72). For example, DSP 12 may receive a MIDI event to increase a gain for a left channel parameter in a set of voice parameters for a middle C voice for a piano. In this way, the middle C voice for a piano may sound like the note is coming from the left. If DSP 12 determines that the MIDI event is an instruction to update a parameter of a MIDI voice ("YES" of 72), DSP 12 may update the parameter in RAM unit 10 (74).

On the other hand, if DSP 12 determines that the MIDI event is not an instruction to update a parameter of a MIDI voice ("NO" of 72), DSP 12 may generate a list of voice indicators (75). Each of the voice indicators in the linked list indicates a MIDI voice for the MIDI frame by specifying a memory location in RAM unit 10 that stores a voice parameter set that defines the MIDI voice. Because MIDI hardware unit 18 may generate a digital waveform for MIDI voices subject to limited time restrictions, it might not be possible for MIDI hardware unit 18 to generate a digital waveform for all MIDI voices specified by MIDI instructions for a MIDI frame. Consequently, the MIDI voices indicated by the voice indicators in the linked list are those MIDI voices that have a greatest acoustical significance during the MIDI frame. The list of voice indicators may be a linked list. That is, each voice indicator in the list may be associated with a pointer to a memory address of a next voice indicator in the list, except for a last voice indicator in the list.

In order to ensure that MIDI hardware unit 18 only generates digital waveforms for the most significant MIDI voices, DSP 12 may use one or more heuristic algorithms to identify the most acoustically significant voices. For example, DSP 12 may identify those voices that have the highest average volume, those voices that form necessary harmonies, or other acoustic characteristics. DSP 12 may generate the list of voice indicators such that the most acoustically significant voice is first in the list, the second most acoustically significant voice is second in the list, and so on. In addition, DSP 12 may remove from the list any voices that are not active in the MIDI frame.

After generating the list of voice indicators, DSP 12 may determine whether MIDI hardware unit 18 is idle (76). MIDI hardware unit 18 may be idle before generating a digital waveform for a first MIDI frame of a MIDI file or after completing the generation of a digital waveform for a MIDI frame. If MIDI hardware unit 18 is not idle ("NO" of 76), DSP 12 may wait one or more clock cycles and then again determine whether MIDI hardware unit 18 is idle (76).

If MIDI hardware unit 18 is idle ("YES" of 76), DSP 12 may load a set of instructions into program RAM units 44 in MIDI hardware unit 18 (78). For example, DSP 12 may determine whether instructions have already been loaded into program RAM units 44. If instructions have not already been loaded into program RAM units 44, DSP 12 may transfer such instructions into program RAM units 44 using direct memory exchange (DME). Alternatively, if instructions have already been loaded into program RAM units 44, DSP 12 may skip this step.

After DSP 12 has loaded the program instructions into program RAM units 44, DSP 12 may activate MIDI hardware unit 18 (80). For example, DSP 12 may activate MIDI hardware unit 18 by updating a register in MIDI hardware unit 18 or by sending a control signal to MIDI hardware unit 18. After activating MIDI hardware unit 18, DSP 12 may wait until DSP 12 receives an interrupt from MIDI hardware unit 18 (82). While waiting for the interrupt, DSP 12 may process and output a digital waveform for a previous MIDI frame. In addition, DSP 12 may also generate a list of voice indicators for a next MIDI frame. Upon receiving the interrupt, an interrupt service register in DSP 12 may set up a DME request to transfer the digital waveform for a MIDI frame from summing buffer 40 in MIDI hardware unit 18 (84). In order to avoid long periods of hardware idling when the digital waveform in summing buffer 40 is being transferred, the direct memory exchange request may transfer the digital waveform from summing buffer 40 in thirty-two 32-bit word blocks. The data integrity of the digital waveform may be maintained by a locking mechanism in summing buffer 40 that prevents processing elements 34 from over-writing data in summing buffer 40. Because this locking mechanism may be released block-by-block, the direct memory exchange transfer may proceed in parallel to hardware execution.

After DSP 12 receives the audio sample for a MIDI frame from MIDI hardware unit 18, DSP 12 may buffer the digital waveform until DSP 12 has completely outputted to DAC 14 a digital waveform for a MIDI frame that precedes the digital waveform for the MIDI frame received from MIDI hardware unit 18 (86). After DSP 12 has completely outputted the digital waveform for the previous MIDI frame, DSP 12 may output the digital waveform received from MIDI hardware unit 18 for the current MIDI frame (88).

Figure 5:
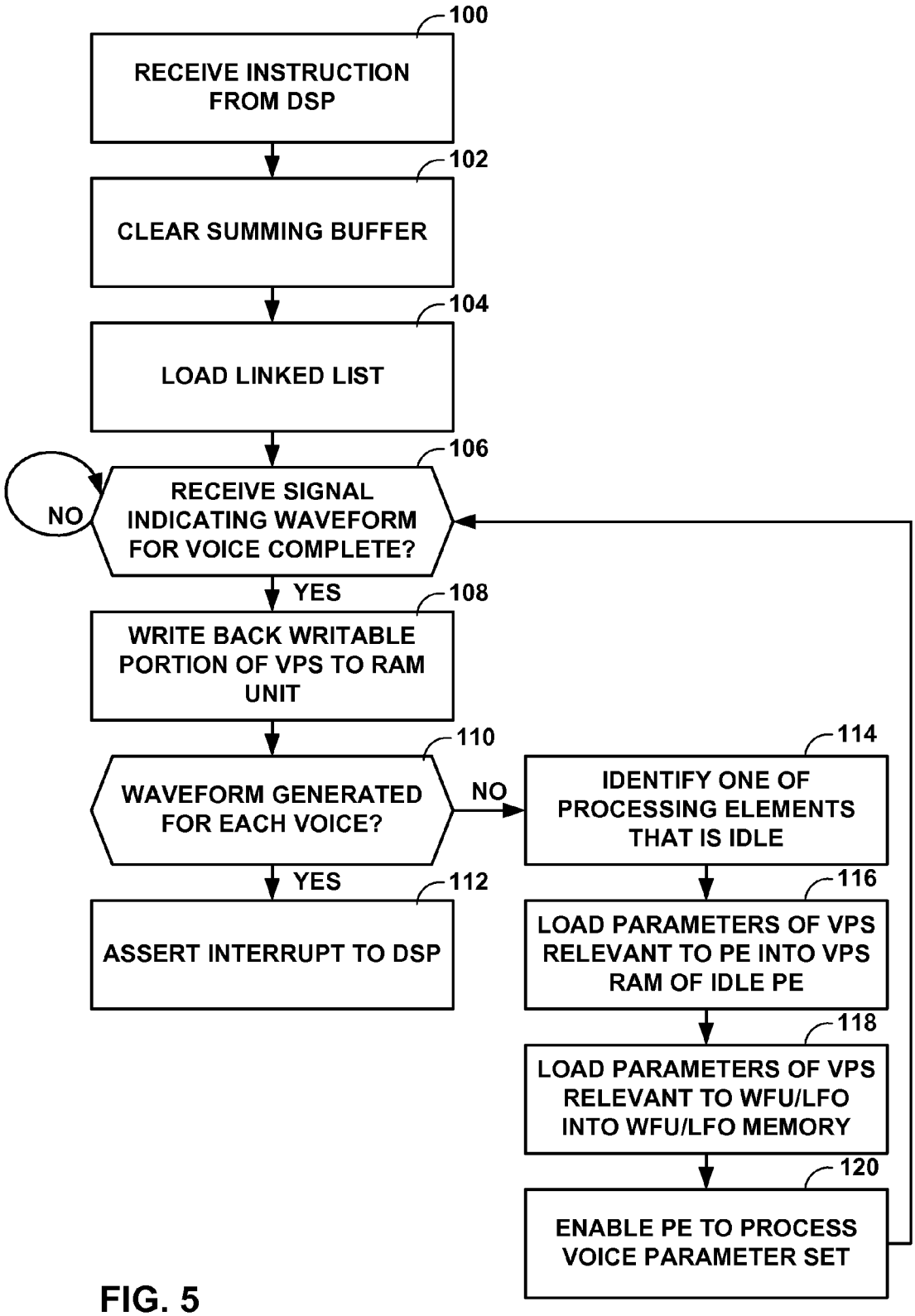
FIG. 5 is a flowchart illustrating an example operation of a coordination module in the MIDI hardware unit of the audio device.

FIG. 5 is a flowchart illustrating an example operation of coordination module 32 in MIDI hardware unit 18 of audio device 4. Initially, coordination module 32 may receive an instruction from DSP 12 to begin generating a digital waveform for a MIDI frame (100). After receiving the instruction from DSP 12, coordination module 32 may clear the content of summing buffer 40 (102). For example, coordination module 32 may instruct summing buffer 40 to set a digital waveform in summing buffer 40 to all zeros. After coordination module 32 clears the content of summing buffer 40, coordination module 32 may load a list of voice identifiers generated by DSP 12 from RAM unit 10 into linked list memory 42 (104).

After loading the linked list of voice indicators, coordination module 32 may determine whether coordination module 32 has received a signal from one of processing elements 34 that indicates that the processing element has finished generating a digital waveform for a MIDI voice (106). When coordination module 32 has not received a signal from one of processing elements 34 that indicates that a processing element has finished generating a digital waveform for a MIDI voice ("NO" of 106), processing element 34 may loop back and wait for such a signal (106). When coordination module 32 receives a signal from one of processing elements 34 indicating that the processing element has finished generating a digital waveform a MIDI voice ("YES" of 106), coordination module 32 may write to RAM unit 10 one or more parameters of the voice parameter set stored in the one of VPS RAM units 46 associated with the processing element and in WFU/LFO memory 39 that may have been altered by the processing element, waveform fetch unit 36, or LFO 38 (108). For example, while generating a waveform for a MIDI voice, processing element 34A may alter certain parameters of the voice parameter set in VPS memory 46A. In this case, for instance, processing element 34A may update a voice parameter for the voice to indicate a volume level of the voice at the end of a MIDI frame. By writing the updated voice parameters back to RAM unit 10, a given processing element may start generating a digital waveform for the MIDI voice in the next MIDI frame at a volume level that is the same as a volume level at which the current MIDI frame ended. Other writable parameters may include left-right balance, overall phase shift, phase shift of a triangular waveform produced by LFO 38, or other acoustic characteristics.

After coordination module writes the parameters back to RAM unit 10, coordination module 32 may determine whether processing elements 34 have generated digital waveforms for each MIDI voice indicated by a voice indicator in the list (110). For example, coordination module 32 may maintain a pointer that indicates a current voice indicator in the linked list of voice indicators. Initially, this pointer may indicate a first voice indicator in the linked list. If processing elements 34 have generated a digital waveform for each of the MIDI voices indicated in the list ("YES" of 110), coordination module 32 may assert an interrupt to DSP 12 to indicate that an overall digital waveform for the MIDI frame is complete (112).

On the other hand, if processing elements 34 have not generated a digital waveform for each of the MIDI voices indicated by voice indicators in the list ("NO" of 110), coordination module 32 may identify one of processing elements 34 that is idle (114). If all of processing elements 34 are not idle (i.e, are busy), coordination module 32 may wait until one of processing elements 34 is idle. After identifying one of processing elements 34 that is idle, coordination module 32 may load parameters of the voice parameter set indicated by the current voice indicator into the one of VPS RAM units 44 associated with the idle processing element (112). Coordination module 32 might only load those parameters of the voice parameter set that are relevant to the processing element into the VPS RAM unit. In addition, coordination module 32 may load parameters of the voice parameter set that are relevant to WFU 36 and LFO 38 into WFU/LFO RAM unit 39 (118). Coordination module 32 may then enable the idle processing element to start generating a digital waveform for the MIDI voice (120). Next, coordination module 32 may update the current voice indicator to the next voice indicator in the list and loop back to determine again whether coordination module 32 has received a signal indicating that one of processing elements 34 has completed generating a digital waveform for the MIDI voice (106).

Figure 6:
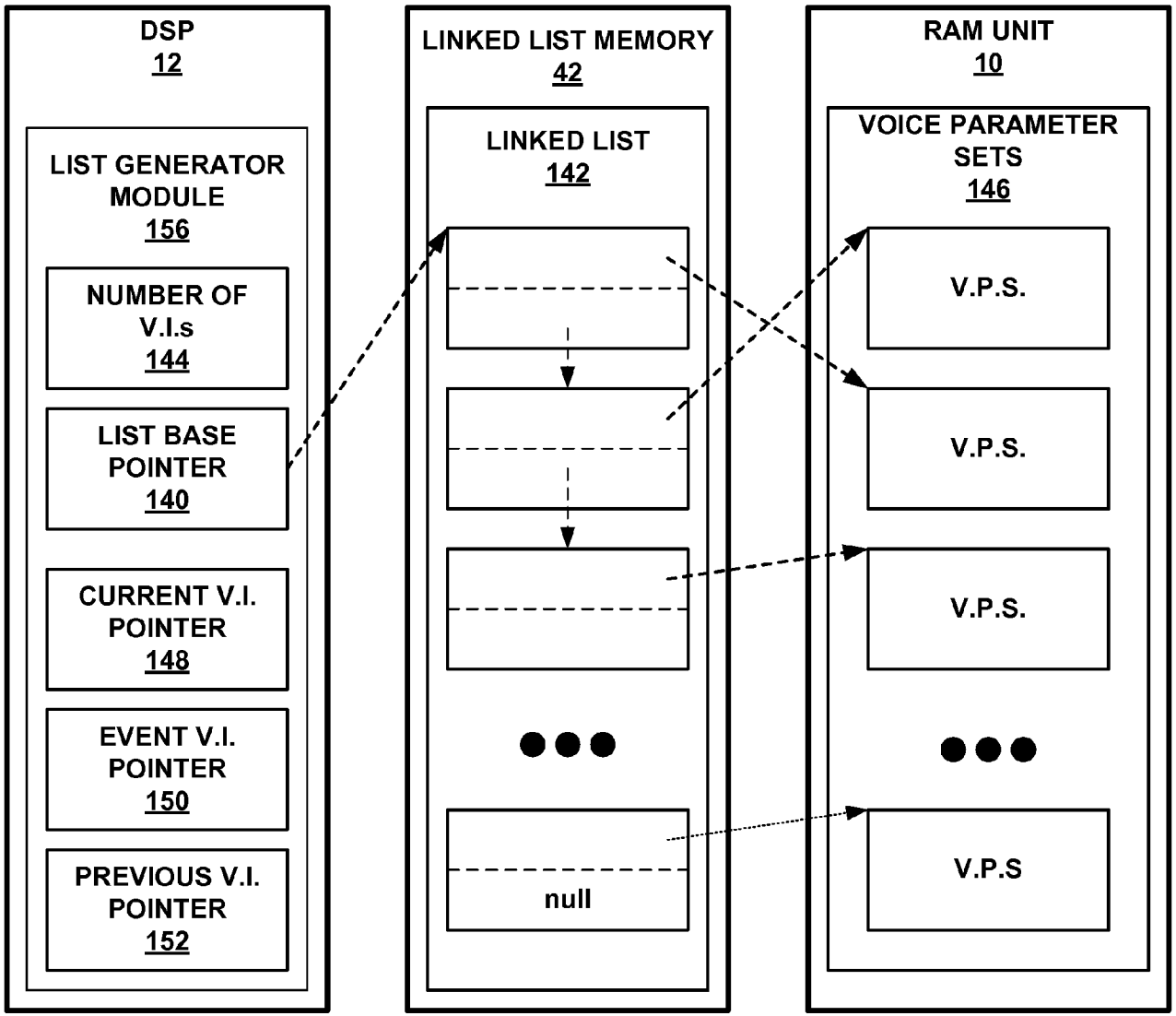
FIG. 6 is a block diagram illustrating an example DSP that uses a list of voice indicators that specify memory addresses.

FIG. 6 is a block diagram illustrating an example DSP 12 that uses a list of voice indicators that specify memory addresses. As illustrated in the example of FIG. 6, DSP 12 includes a register that stores a list base pointer 140. List base pointer 140 may specify a memory address of a first voice indicator in a list of voice indicators 142 in linked list memory 42. If there are no voice indicators in list 142, as may be the situation at the beginning of a MIDI file, the value of list base pointer 140 may be a null address. In addition, DSP 12 includes a register that stores a value in number of voice indicators register 144. The value in number of voice indicators register 144 specifies a tally of the number of voice indicators in list 142. In the example data structure illustrated in FIG. 6, each voice indicator in list 142 may comprise a memory address of a voice parameter set in RAM unit 10 and a memory address of a next voice indicator in linked list memory 42. A last voice indicator in list 142 may specify a null address for the address of a next voice indicator in list 142.

RAM unit 10 may contain a set of voice parameter sets 146. Each voice parameter set in RAM unit 10 may be a block of contiguous memory locations that specify values of voice parameters in a voice parameter set. A memory address of a memory location of a first voice parameter may serve as a memory address for the voice parameter set.

Before DSP 12 receives a first MIDI event of a MIDI file, list 142 might not contain any voice indicators. To reflect the fact that list 142 does not contain any voice indicators, the value of list base pointer 140 may be a null memory address and a value in number of voice indicators register 144 may specify the number zero. At the start of a first MIDI frame of a MIDI file, processor 8 may provide to coordination module 32 a set of MIDI events that occur during the MIDI frame. For example, processor 8 may provide to DSP 12 MIDI events to turn voices on, MIDI events to turn voices off, MIDI events associated with aftertouch effects, and to produce other such effects. To process the MIDI events, a list generator module 156 in DSP 12 may generate linked list 142 in linked list memory 42. In general, list generator module 156 does not completely generate list 142 during each MIDI frame. Rather list generator module 156 may reuse the voice indicators already present in list 142.

To generate linked list 142, list generator module 156 may determine whether list 142 already includes a voice indicator that specifies a memory address of one of voice parameter sets 146 for each MIDI voice specified in the set of MIDI events provided by DSP 12. If list generator module 156 determines that list 142 includes a voice indicator of one of the MIDI voices, list generator module 156 may remove the voice indicator from list 142. After removing the voice indicator from list 142, list generator module 156 may add the voice indicator back into list 142. When list generator module 156 adds the voice indicator back into list 142, list generator module 156 may start at the first voice indicator in the list and determine whether the MIDI voice indicated by the removed voice indicator is more acoustically significant than the voice indicated by the first voice indicator in list 142. In other words, list generator module 156 may determine which voice is more important to the sound. List generator module 156 may apply one or more heuristic algorithms to determine whether the MIDI voice specified in the MIDI event or the MIDI voice specified by the first voice indicator is more acoustically significant. For example, list generator module 156 may determine which of the two MIDI voices has the loudest average volume during the current MIDI frame. Other psychoacoustical techniques may be applied to determine acoustical significance. If the MIDI voice indicated by the removed voice indicator is more significant than the voice indicated by the first voice indicator in list 142, list generator module 156 may add the removed voice indicator to the top of the list.

When list generator module 156 adds the removed voice indicator to the top of the list, list generator module 156 may change the value of list base pointer to be equal to the memory address of the removed voice indicator. If the MIDI voice indicated by the removed voice indicator is not more significant than the MIDI voice indicated by the first voice indicator, list generator module 156 continues down list 142 until list generator module 156 identifies a MIDI voice indicated by one of the voice indicators in list 142 that is less significant than the MIDI voice indicated by the removed voice indicator. When list generator module 156 identifies such a MIDI voice, list generator module 156 may insert the removed voice indicator into list 142 above (i.e., in front of) the voice indicator for the identified MIDI voice. If the MIDI voice indicated by the removed voice indicator is less acoustically significant than all other MIDI voices indicated by the voice indicators in list 142, list generator module 156 adds the removed voice indicator to the end of list 142. List generator module 156 may perform this process for each MIDI voice in the set of MIDI events.

If list generator module 156 determines that list 142 does not include a voice indicator for a MIDI voice associated with a MIDI event, list generator module 156 may create a new voice indicator in linked list memory 42 for the MIDI voice. After creating the new voice indicator, list generator module 156 may insert the new voice indicator into list 142 in the manner described above for the removed voice indicator. In this way, list generator module 156 may generate a linked list in which the voice indicators in the linked list are arranged in a sequence according to acoustical significance of the MIDI voices indicated by the voice indicators in the list. As one example, list generator module 156 may generate a list of voice indicators that indicate MIDI voices from the most significant voice to the least significant voice in a MIDI frame.

In the example of FIG. 6, DSP 12 includes a set of pointers that assist list generator module 156 in generating list 142. This set of pointers includes a current voice indicator pointer 148 that holds a memory address of a voice indicator that list generator module 156 is currently using, an event voice indicator pointer 150 that holds a memory address of a voice indicator that list generator module 156 is inserting into list 142, and a previous voice indicator pointer 152 that holds a memory address of a voice indicator that list generator module 156 used before the voice indicator that list generator module 156 is currently using.

If the value in number of voice indicators register 144 exceeds a maximum number of voice indicators, list generator module 156 may deallocate memory associated with a voice indicator in list 142 that indicates a least significant MIDI voice. If voice indicators in list 142 are arranged from most significant to least significant, list generator module 156 may identify the voice indicator in list 142 that indicates a least significant MIDI voice by following the chain of next voice indicator memory addresses until list generator module 156 identifies a voice indicator that includes a next voice indicator memory address that specifies a null memory address. After deallocating the memory associated with a last voice indicator, list generator module 156 may decrement the value in number of voice indicators register 144 by one.

After list generator module 156 generates list 142, list generator module 156 may provide the values of list base pointer 140 and number of voice indicators 144 to coordination module. Coordination module 32 may include registers (not shown) to hold these values of list base pointer 140 and number of voice indicators 144. Coordination module 32 use these values to access list 142 and to assign MIDI voices indicated by voice indicators in list 142 to processing elements 32. For example, when list generator module 156 finishes generating list 142, coordination module 32 may use the value of list base pointer 140 provided by list generator module 156 to load list 142 into linked list memory 42. Coordination module 32 may then identify one of processing elements 34 that is idle. Coordination module 32 may then obtain a memory address of a memory location in RAM unit 10 that stores a voice parameter set that defines a MIDI voice indicated by a voice indicator in list 142 at the memory location specified by a pointer in coordination module 32 that indicates a current voice indicator. Coordination module 32 may then use the obtained memory address to store at least some voice parameters in the voice parameter set into the one of VPS RAM units 46 associated with the idle processing element. After storing the voice parameter set in the VPS RAM unit, coordination module 32 may send a signal to the processing element to begin generating a waveform for the voice. Coordination module 32 may continue this until processing elements 34 have generated waveforms for each voice indicated by voice indicators in list 142.

The use by DSP 12 and coordination module 32 of a linked list of voice indicators may present several advantages. For example, because DSP 12 sorts and rearranges a linked list of voice indicators that indicate voice parameter sets, it is not necessary to sort and rearrange the actual voice parameter sets in RAM unit 10. A voice indicator may be significantly smaller than a voice parameter set. As a result, DSP 12 moves (i.e., writes and reads) less data to and from RAM unit 10. Therefore, DSP 12 may require less bandwidth on a bus from coordination module 32 to RAM unit 10 than if DSP 12 sorted and rearranged the voice parameter sets. Furthermore, because DSP 12 moves less data to and from RAM unit 10, DSP 12 may consume less power than if DSP 12 moved actual voice parameter sets. Also, the use of a linked list of voice indicators may permit DSP 12 to provide voice parameter sets to processing elements 34 in an arbitrary order. Providing voice parameter sets to processing elements 34 in an arbitrary order may be useful in certain types of audio processing.

In addition, the use of a linked list of indicators may have applicability in contexts other than identifiers of MIDI voice set parameters. For example, the indicators may indicate preprogrammed digital filters rather than sets of MIDI voice parameters. Each preprogrammed digital filter may provide the five coefficients for a bi-quadratic filter. A bi-quadratic filter is a two-pole, two-zero digital filter that filters out frequencies that are further away from the poles. Bi-quadratic filters may be used to program audio equalizers. Like MIDI voices, a first digital filter may be more or less significant than a second digital filter. Therefore, a module that applies digital filters may use a sorted linked list of indicators to digital filter parameters to efficiently apply a set of digital filters. For example, a module of audio device 4 may apply filters to a digital waveform after DSP 12 generates the digital waveform.

Figure 7:
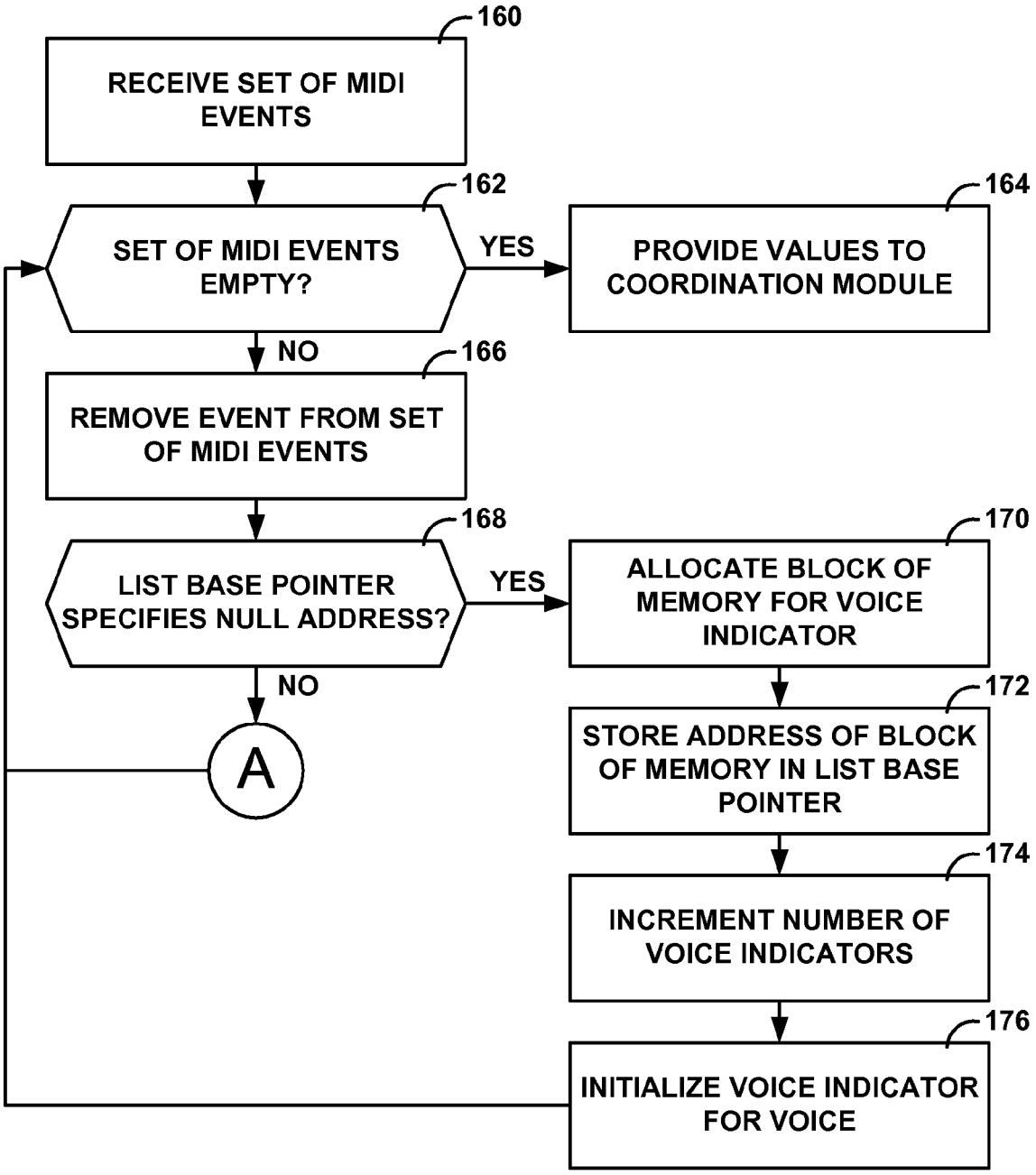
FIG. 7 is a flowchart illustrating an exemplary operation of a DSP when the DSP receives a set of MIDI events from the processor.

FIG. 7 is a flowchart illustrating an exemplary operation of DSP 12 when DSP 12 receives a set of MIDI events from processor 8. Initially, DSP 12 may receive a set of MIDI events from processor 8 (160). After DSP 12 receives the set of MIDI events, list generator module 156 may determine whether the set of MIDI events is empty (162). If the set of MIDI events is empty ("YES" of 162), list generator module 156 may provide the value of list base pointer 140 to coordination module 32 (164).

Figure 8:
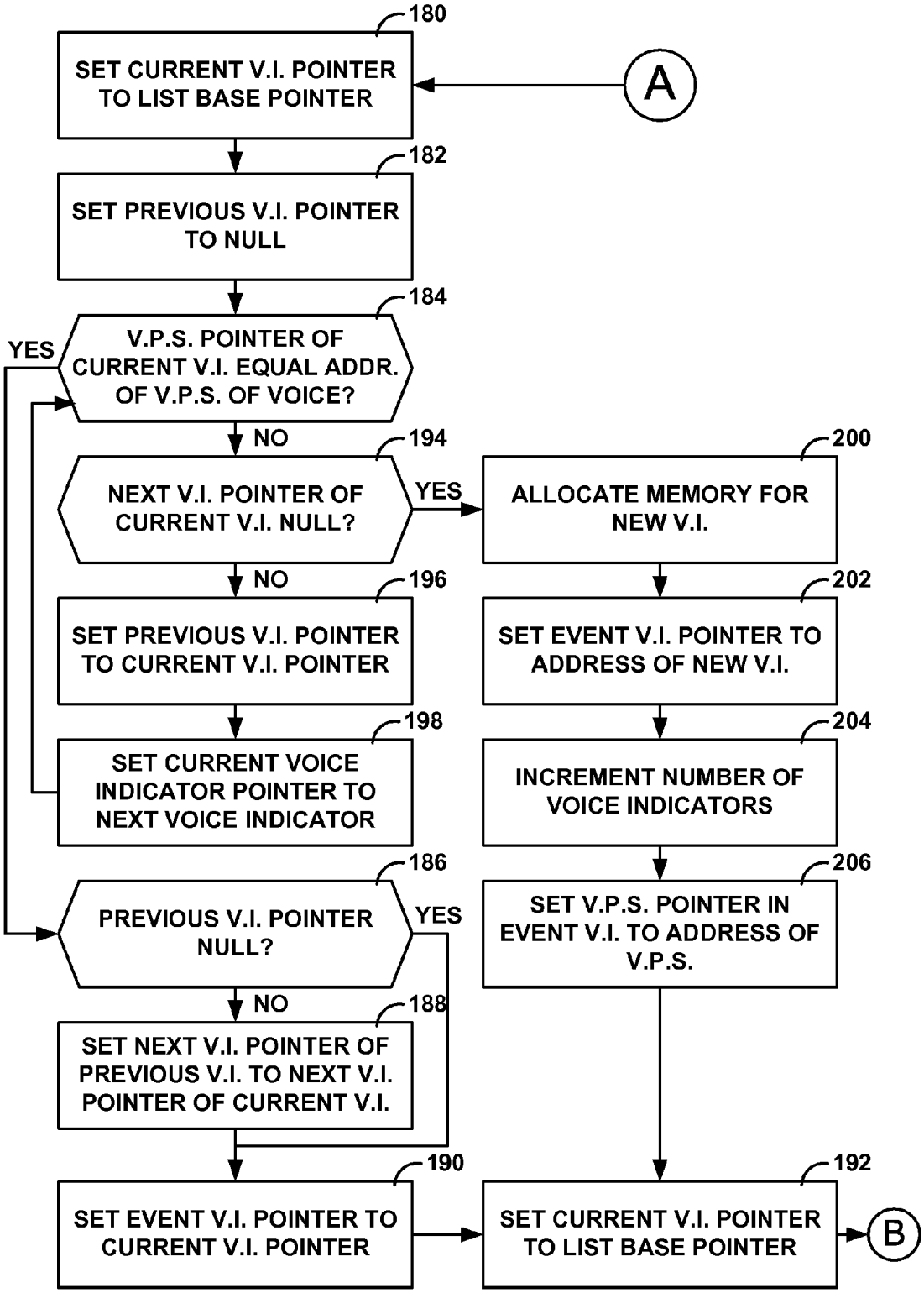
FIG. 8 is a flowchart illustrating an example operation of the DSP when the DSP inserts a voice indicator into a list of voice indicators.
Figure 9:
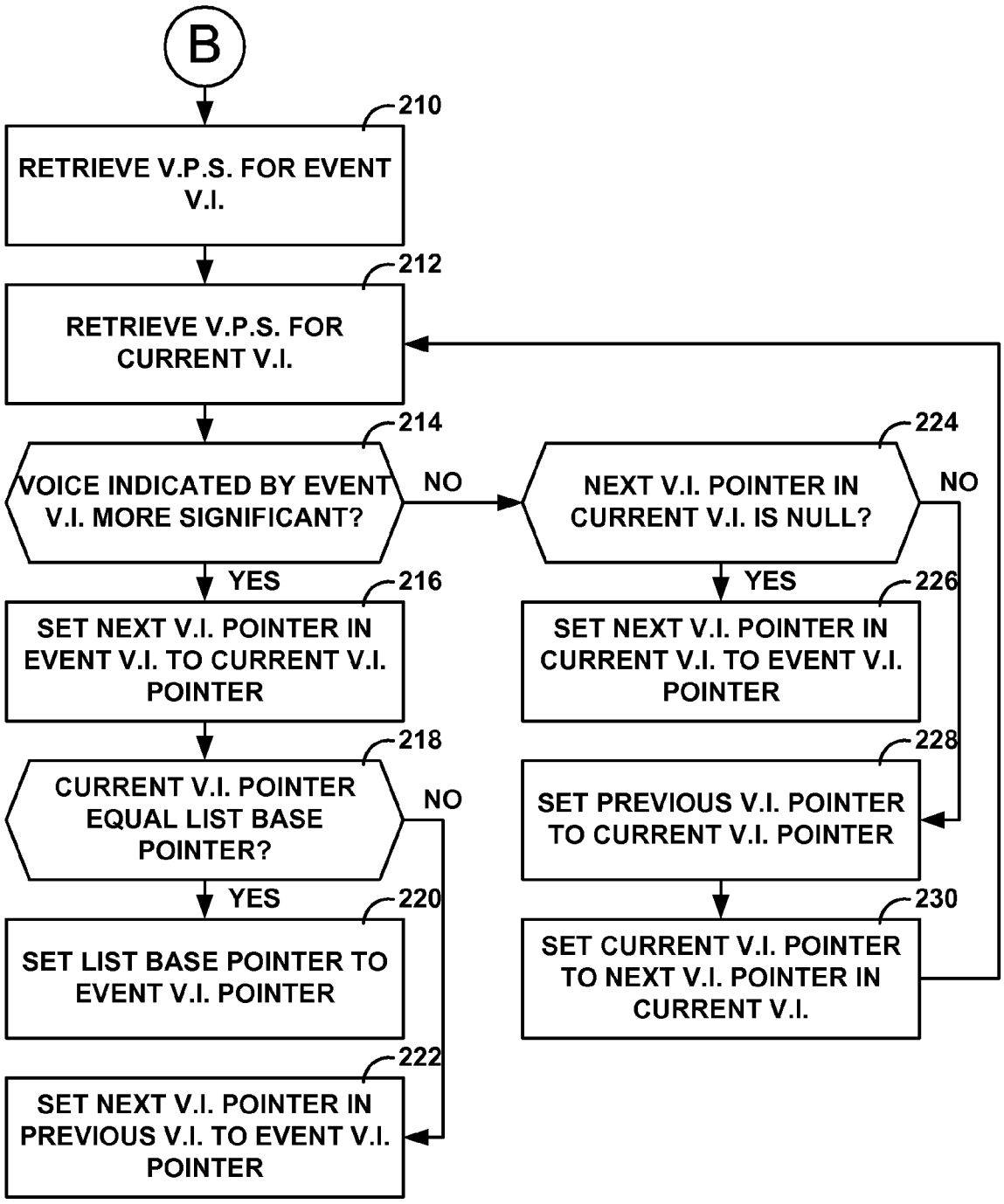
FIG. 9 is a flowchart illustrating an exemplary operation of the DSP when the DSP inserts a voice indicator into the list.

On the other hand, if the set of MIDI events is not empty ("NO" of 162), list generator module 156 may remove an event from the set of MIDI events (166). The removed event is referred to herein as the "current event" and a MIDI voice or MIDI voices associated with the current event are referred to herein as the "current voice." After list generator module 156 removes the current event from the set of MIDI events, list generator module 156 may determine whether the value of list base pointer 140 is a null address (168). If the value of list base pointer 140 is not a null address ("NO" of 168), list generator module 156 may insert a voice indicator for the current voice into list 142. FIGS. 8 and 9 illustrate an exemplary procedure for inserting a voice indicator into list 142. After list generator module 156 inserts the voice indicator into list 142, list generator module 156 may loop back and again determines whether the set of MIDI events is empty (162).

If the value of list base pointer 140 specifies a null address ("YES" of 168), list generator module 156 may allocate a contiguous block of memory in linked list memory 42 for a voice indicator for the current voice (170). After allocating the block of memory, list generator module 156 may store a memory address of the block of memory in list base pointer 140 (172). List generator module 156 may then increment the value in number of voice indicators register 144 by one (174). In addition, list generator module 156 may initialize the voice indicator for the current voice (176). To initialize the voice indicator, list generator module 156 may set the next voice indicator pointer of the voice indicator to null and set the voice parameter set pointer of the voice indicator to the memory address in voice parameter sets 146 of the voice parameter set of the current voice. After initializing the voice indicator, list generator module 156 may loop back and again determine whether the set of MIDI events is empty (162).

FIG. 8 is a flowchart illustrating an example operation of DSP 12 when DSP 12 inserts a voice indicator into list of voice indicators 142. In particular, the example in FIG. 8 illustrates an operation in which list generator module 156 in DSP 12 removes a voice indicator of a current voice from list 142 or creates a new voice indicator for the current voice so that the voice indicator may be subsequently inserted at a proper location in list 142. In FIGS. 8, 9, 10 and 11, the term "voice indicator" is abbreviated "V.I." and the term "voice parameter set" is abbreviated "V.P.S." The flowchart illustrated in the example of FIG. 8 starts at the circle marked "A" and which corresponds to the circled marked "A" in the example of FIG. 7.

Initially, list generator module 156 may set the value of current voice indicator pointer 148 to the value of list base pointer 140 (180). Next, list generator module 156 may set the value of previous voice indicator pointer 152 to null (182). After setting the value of previous voice indicator pointer 152 to null, list generator module 156 may determine whether a voice parameter pointer of the current voice indicator (i.e., the voice indicator having a memory address equal to the memory address in current voice indicator pointer 148) equals a memory address of the voice parameter set of the voice of the current event (184).

If list generator module 156 determines that the voice parameter pointer of the current voice indicator equals the memory address of the voice parameter set ("YES" of 184), list generator module 156 may determine whether the value of previous voice indicator pointer 152 is a null address (186). If list generator module 156 determines that the value of previous voice indicator pointer 152 is not a null address ("NO" of 186), list generator module 156 may set a next voice indicator pointer of the previous voice indicator (i.e., the indicator having a memory address equal to the memory address in previous voice indicator pointer 152) to the value of the next voice indicator pointer of the current voice indicator (188). After setting the next voice indicator pointer of the previous voice indicator, list generator module 156 may set the value of event voice indicator pointer 150 to the value of current voice indicator pointer 148 (190). List generator module 156 may also set the value of event voice indicator pointer 150 to the value of current voice indicator pointer 148 when the value of previous voice indicator pointer 152 is null ("YES" of 186). In this way, list generator module 156 does not attempt to set a next voice indicator pointer of a voice indicator at a null memory address. After list generator module 156 sets the value of event voice indicator pointer 148, list generator module 156 may set the value of current voice indicator pointer 148 to the value of list base pointer 140 (192). List generator module 156 may then use the example operation illustrated in FIG. 9 to reinsert the voice indicator pointed to by event voice indicator pointer 150.

If list generator module 156 determines that the voice parameter set of the current voice indicator does not equal the memory address of the voice parameter set ("NO" of 184), list generator module 156 may determine whether the value of the next voice indicator pointer of the current voice indicator is null (194). In other words, list generator module 156 may determine whether the current voice indicator is the last voice indicator in list 142. If list generator module 156 determines that the value of the next voice indicator pointer of the current voice indicator is not null ("NO" of 194), list generator module 156 may set the value of previous voice indicator pointer 152 to the value of current voice indicator pointer 148 (196). List generator module 156 may then set the value of current voice indicator pointer 148 to the value of the next voice indicator pointer in the current voice indicator (198). In this way, list generator module 156 may advance the current voice indicator to the next voice indicator in list 142. List generator module 156 may then loop back and again determine whether the voice parameter set pointer of the new current voice indicator equals the address of the voice parameter set of the current voice (184).

On the other hand, if list generator module 156 determines that the next voice indicator pointer of the current voice indicator is null ("YES" of 194), list generator module 156 has reached the end of list 142 without locating a voice indicator for the current voice. For this reason, list generator module 156 may create to new voice indicator for the current voice. To create a new voice indicator for the current voice, list generator module 156 may allocate memory in linked list memory 42 for a new voice indicator (200). List generator module 156 may then set the value of event voice indicator pointer 148 to the memory address of the new voice indicator (202). The new voice indicator is now the event voice indicator. Next, list generator module 156 may increment the value of number of voice indicators register 144 by one (204). After incrementing the value of number of voice indicators register 144, list generator module 156 may set the voice parameter set pointer of the event voice indicator to contain the memory address of the voice parameter set of the current voice (206). List generator module 156 may then set the value of current voice indicator pointer 148 to the value of list base pointer 140 (192) and may then insert the event voice indicator into list 142 according to the example operation illustrated in FIG. 9.

FIG. 9 is a flowchart illustrating an exemplary operation of DSP 12 when the DSP inserts a voice indicator into list 142. The flowchart illustrated in the example of FIG. 9 starts at the circle marked "B" and which corresponds to the circled marked "B" in the example of FIG. 8.

Initially, list generator module 156 in DSP 12 may retrieve a voice parameter set from RAM unit 10 indicated by the event voice indicator (210). List generator module 156 may then retrieve a voice parameter set from RAM unit 10 indicated by the current voice indicator (212). After retrieving both voice parameter sets, list generator module 156 may determine the relative acoustical significance of the MIDI voices, based on values in the voice parameter sets (214).

If the MIDI voice indicated by the event voice indicator is more significant than the MIDI voice indicated by the current voice indicator ("YES" of 214), list generator module 156 may set the next-voice indicator in the event voice indicator to the value of current voice indicator pointer 148 (216). After setting the next-voice indicator, list generator module 156 may determine whether the value of current voice indicator pointer 148 equals the value of list base pointer 140 (218). In other words, list generator module 156 may determine whether the current voice indicator is the first voice indicator in list 142. If the value of current voice indicator pointer 148 equals the value of list base pointer 140 ("YES" of 218), list generator module 156 may set the value of list base pointer 140 to the value of event voice indicator pointer 150 (220). In this way, the event voice indicator becomes the first voice indicator in list 142. Otherwise, if the value of current voice indicator pointer 148 does not equal the value of list base pointer 140 ("NO" of 218), list generator module 156 may set the value of the next-voice indicator pointer in the previous voice indicator to the value of event voice indicator pointer 150 (222). In this way, list generator module 156 may link the event voice indicator into list 142.

On the other hand, if the MIDI voice indicated by the event voice indicator is not more significant than the MIDI voice indicated by the current voice indicator ("NO" of 214), list generator module 156 may determine whether the value of the next-voice indicator pointer in the current voice indicator is null (224). If the value of the next-voice indicator pointer is null, then the current voice indicator is the last voice indicator in list 142. If the value of the next-voice indicator pointer in the current voice indicator is null ("YES" of 224), list generator module 156 may set the value of the next-voice indicator pointer in the current voice indicator to the value of event voice indicator pointer 150 (226). In this way, list generator module 156 may add the event voice indicator to the end of list 142 when the voice indicated by the event voice indicator is the least significant voice in list 142.

However, if the next-voice indicator pointer in the current voice indicator is not null ("NO" of 224), the current voice indicator is not the last voice indicator in list 142. For this reason, list generator module 156 may set the value of previous voice indicator 152 to the value of current voice indicator pointer 148 (228). Then, list generator module 156 may set the value of current voice indicator pointer 148 to the value of the next-voice indicator pointer in the current voice indicator (230). After setting the value of current voice indicator pointer 148, list generator module 156 may loop back to again retrieve a voice parameter set indicated by the current voice indicator (212).

Figure 10:
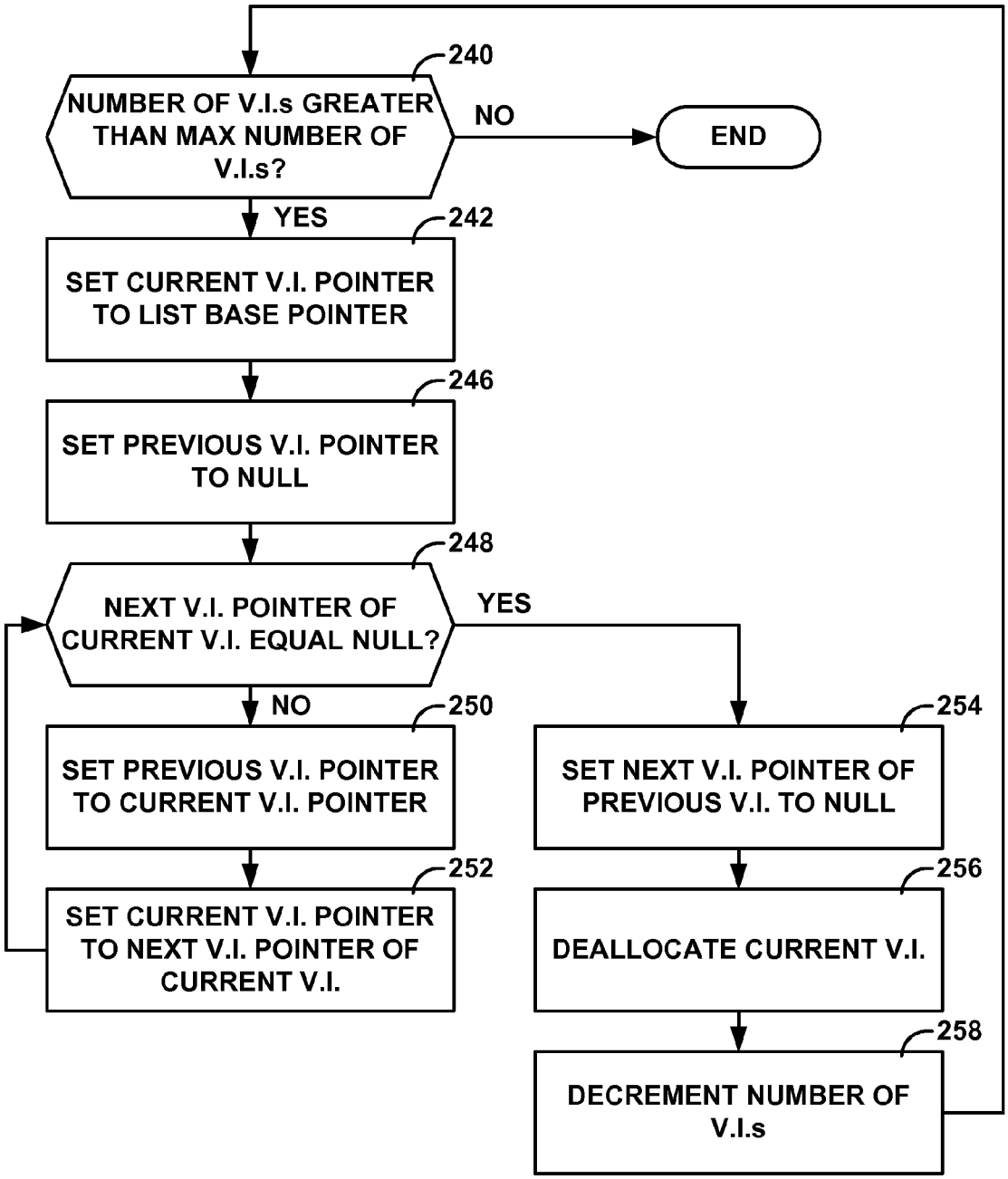
FIG. 10 is a flowchart illustrating an exemplary operation of the DSP when the DSP removes voice indicators from the list when the number of voice indicators in the list exceeds a maximum number of voice indicators.

FIG. 10 is a flowchart illustrating an exemplary operation of DSP 12 when the DSP removes voice indicators from list 142 when the number of voice indicators in list 142 exceeds a maximum number of voice indicators. For example, DSP 12 may limit the maximum number of voice indicators in list 142 to ten. In this example, MIDI hardware unit 18 would only generate digital waveforms for the ten most acoustically significant MIDI voices in the MIDI frame. DSP 12 may set a maximum number of voice indicators in list 142 because without a limited number of voices, MIDI hardware unit 18 may be unable to process all of the voices in list 142 within the time permitted by a MIDI frame. In addition, DSP 12 may set a maximum number of voice indicators in list 142 to conserve space in linked list memory 42. Furthermore, a maximum number of voice indicators for list 142 may set an upper limit on the number of calculations required to insert a new voice indicator into list 142. Setting an upper limit on the number of calculations may be a requirement to generate a digital waveform for a MIDI frame in real time.

Initially, list generator module 156 in DSP 12 may determine whether the value of number of voice indicators register 144 is greater than a maximum number of voice indicators in list 142 (240). If the value in number of voice indicators register 144 is not greater than the maximum number of voice indicators ("NO" of 240), there may be no need to remove any voice indicators from list 142. However, in some examples, list generator module 156 may scan through list 142 and remove voice indicators for voices that are not currently active or that have not been active within a given time.

If value in number of voice indicators register 144 is greater than the maximum number of voice indicators ("YES" of 240), list generator module 156 may set the value of current voice indicator pointer 148 to the value of list base pointer 140 (242). Next, list generator module 156 may set the value of previous voice indicator pointer 152 to null (244). At this point, list generator module 156 may determine whether the value of the next-voice indicator pointer of the current voice indicator is null (i.e., whether the current voice indicator is the last voice indicator in list 142) (248). If the value of the next-voice indicator pointer of the current voice indicator is not null ("NO" of 248), list generator module 156 may set the value of previous voice indicator pointer 152 to the value of current voice indicator pointer 148 (250). List generator module 156 may then set the value of current voice indicator pointer 148 to the value of the next-voice indicator pointer of the current voice indicator (252). Next, list generator module 156 may loop back to again determine whether the value of the next-voice indicator pointer of the new current voice indicator equals null (248).

If the value of the next-voice indicator pointer of the current voice indicator equals null ("YES" of 248), the current voice indicator is the last voice indicator in list 142. List generator module 156 may then remove the last voice indicator from list 142. To remove the last voice indicator from list 142, list generator module 156 may set the next-voice indicator pointer of the previous voice indicator to null (254). Next, coordination module 32 deallocates the memory in linked list memory 42 for the current voice indicator (256). Coordination module 32 may then decrement the value in number of voice indicators register 144 (258). After decrementing the value in number of voice indicators register 144, list generator module 156 may loop back to again determine whether the value in number of voice indicators register 144 is greater than the maximum allowed number of voice indicators (240).

Figure 11:
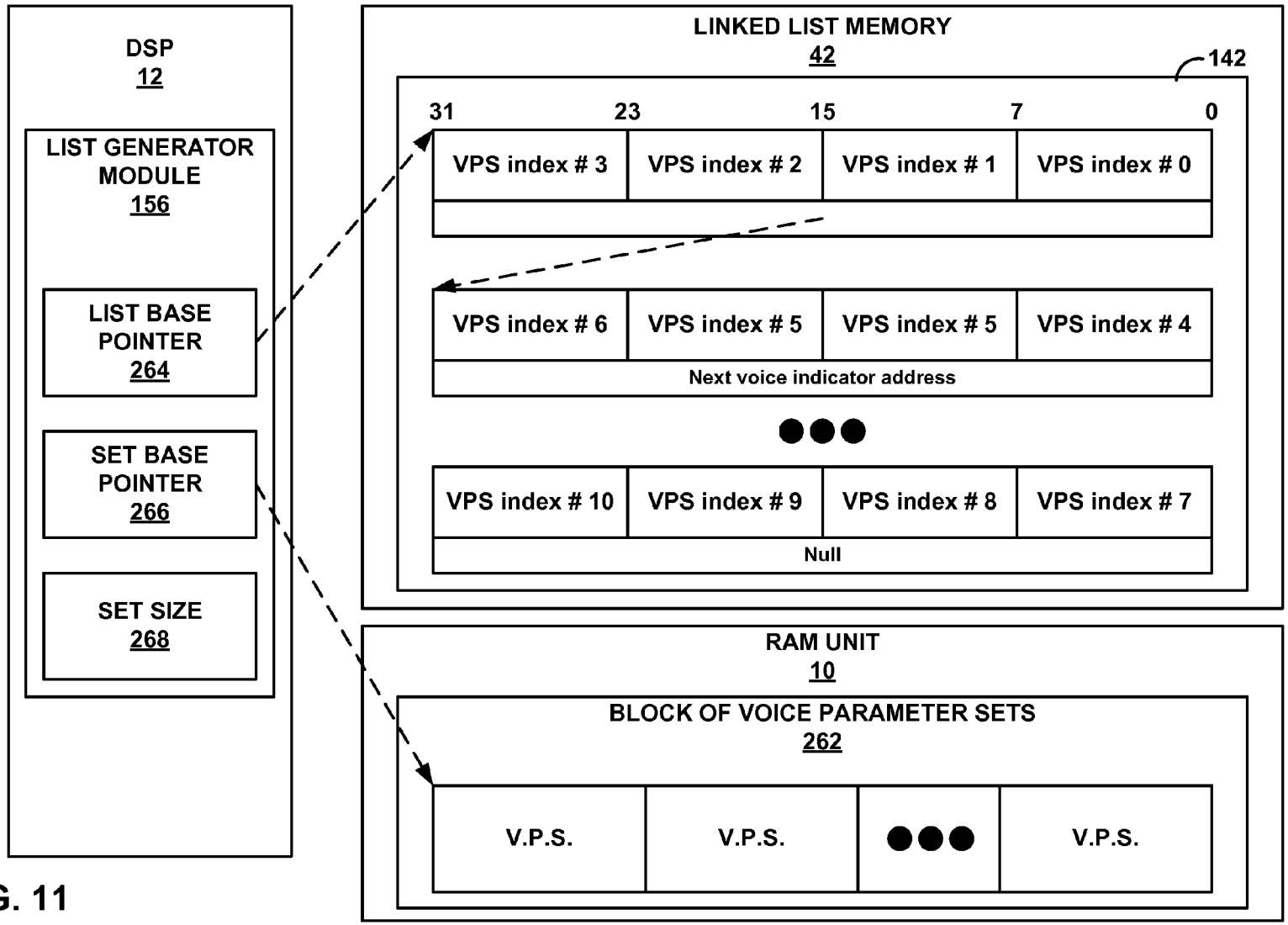
FIG. 11 is a block diagram illustrating an example DSP that uses a list of voice indicators that specify index values from which memory addresses may be derived.
Figure 12:
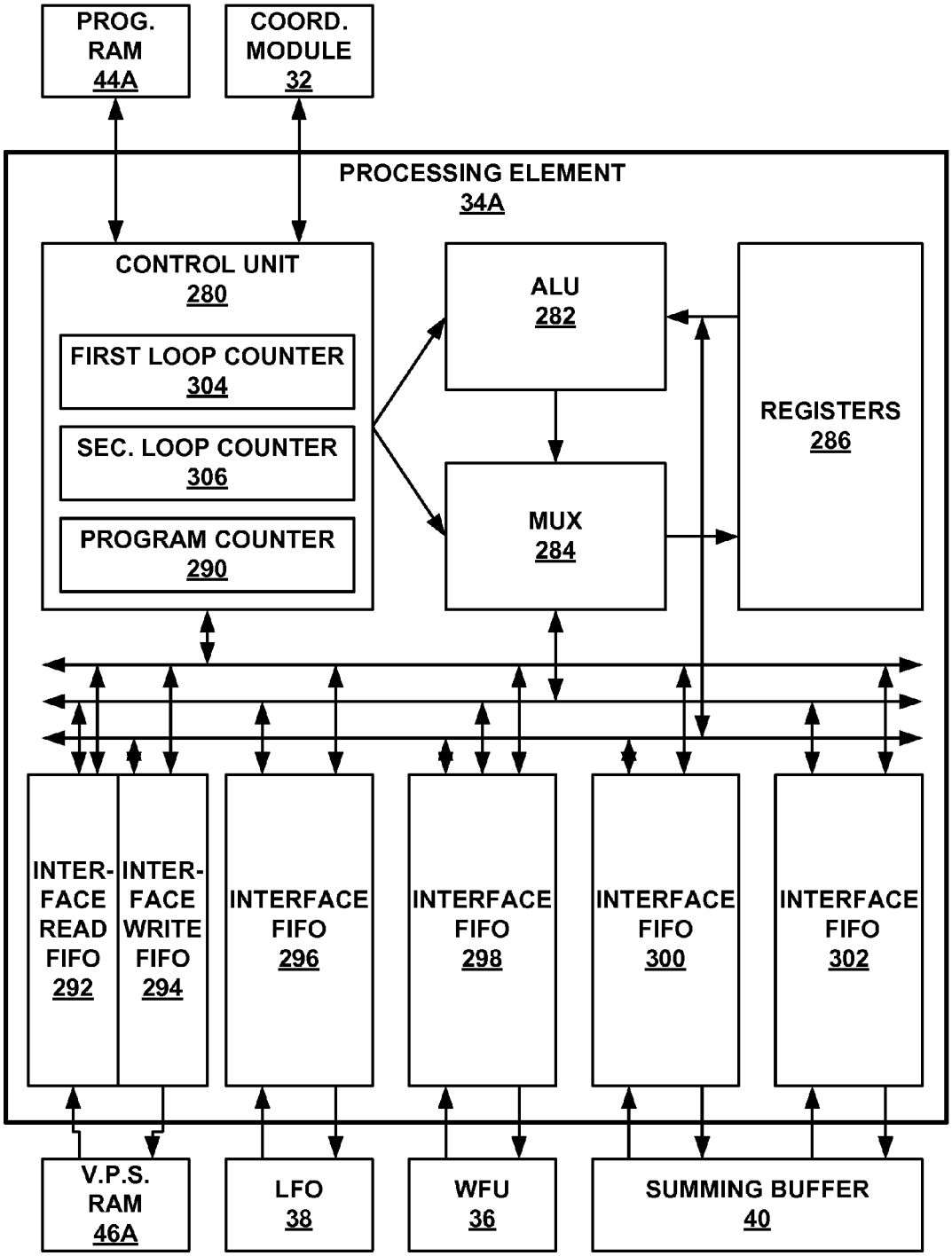
FIG. 12 is a block diagram illustrating details of an exemplary processing element.

FIG. 11 is a block diagram illustrating an example DSP 12 that uses a list of voice indicators that specify index values from which memory addresses may be derived. In the example of FIG. 12, each voice indicator in list 142 includes a 32-bit word that includes four voice parameter set (VPS) index values and a memory address of a next voice indicator in list 142. Each VPS index value in block 260 may specify a number associated with a voice parameter set in block of voice parameter sets 262. For example, a first VPS index value may specify the number "2" to indicate the second voice parameter set in block of voice parameter sets 262. Furthermore, each VPS index value in block 260 may be represented in one byte (i.e., eight bits) of a four byte word in RAM unit 10. Because a VPS index value is represented in one byte, a single VPS index value may indicate one of 256 (i.e., 28=256) voice parameter sets.

Furthermore, in the example of FIG. 11, RAM unit 10 stores each voice parameter set in a contiguous block of memory locations 262. Because RAM unit 10 stores each voice parameter set in a contiguous block, one voice parameter set starts in a memory location immediately following a previous voice parameter set.

When DSP 12 or coordination module 32 needs to access a voice parameter set in block of voice parameter sets 262, DSP 12 or coordination module 32 may first multiply an index value of the voice parameter set in block 260 by the value contained in a set size register 268. The value contained in set size register 268 may equal the number of addressable locations in RAM unit 10 that a single voice parameter set occupies. DSP 12 or coordination module 32 may then add the value of a set base pointer register 266. The value contained in set base pointer register 266 may equal the memory address of the first voice parameter set in block 262. Thus, by multiplying an index of a voice parameter set by the size of a voice pointer set and then adding the memory address of the first voice parameter set, DSP 12 or coordination module 32 may derive the first memory address of the voice parameter set in block 262.

DSP 12 may control the voice indicators in list 142 of FIG. 11 in largely the same manner as coordination module 32 controlled the voice indicators in list 142 in FIGS. 8-10. However, when using this exemplary data structure, DSP 12 may sort VPS index values within a voice indicator.

The example data structure illustrated in FIG. 11 may have an advantage over the example data structure illustrated in FIG. 6 because the data structure illustrated in FIG. 11 may require fewer memory locations in linked list memory 42 to store the same number of pointers to voice parameters sets. However, the data structure illustrated in FIG. 11 may require DSP 12 and coordination module 32 to perform additional computations.

FIG. 12 is a block diagram illustrating details of an exemplary processing element 34A. While the example of FIG. 12 illustrates details of processing element 34A, these details may be applicable to other ones of processing elements 34.

As illustrated in the example of FIG. 12, processing element 34A may comprise several components. These components may include, and are not limited to, a control unit 280, an Arithmetic Logic Unit (ALU) 282, a multiplexer 284, and a set of registers 286. In addition, processing element 34A may include a read interface first-in-first-out (FIFO) 292 for VPS RAM unit 46A, a write interface FIFO for VPS RAM unit 46A, an interface FIFO 296 for LFO 38, an interface FIFO 298 for WFU 36, an interface FIFO 300 for summing buffer 40, and an interface FIFO 302 for RAM in summing buffer 40.

Control unit 280 may comprise a set of circuits that read instructions and that output control signals that control processing element 34A based on the instructions. Control unit 280 may include a program counter 290 that stores a memory address of a current instruction, a first loop counter 304 that stores a counter for a first program loop performed by processing element 34, and a second loop counter 306 that stores a counter for a second program loop performed by processing element 34. ALU 282 may comprise circuits that perform various arithmetic operations on values stored in various ones of registers 286. ALU 282 may be specialized to perform arithmetic operations that have special utility for the generation of digital waveforms for MIDI voices. Registers 286 may be a set of eight 32-bit registers that may hold signed or unsigned values. Multiplexer 284, based on control signals outputted by control unit 280, may direct output from ALU 282, interface read FIFO 292, interface FIFO 296, interface FIFO 298, and interface FIFO 302 to specific ones of registers 286.

Processing element 34A may use a set of program instructions that are specialized to generate digital waveforms for MIDI voices. In other words, the set of program instructions used in processing element 34A may include program instructions not found in generalized instruction sets such as a Reduced Instruction Set Computer (RISC) instruction set or a complex instruction set architecture instruction set such as an x86 instruction set. Furthermore, the set of program instruction used in processing element 34A may exclude some program instructions found in generalized instruction sets.

Program instructions used by processing element 34A may be classified as arithmetic logic unit (ALU) instructions, load/store instructions, and control instructions. Each class of program instructions used by processing element 34A may be a different length. For example, ALU instructions may be twenty bits long, load/store instructions may be eighteen bits long, and control instructions may be sixteen bits long.

ALU instructions are instructions that cause control unit 280 to output control signals to ALU 282. In one exemplary format, each ALU instruction may be twenty bits long. For example, bits 19:18 of an ALU instruction are reserved, bits 17:14 contain an ALU instruction identifier, bits 13:11 contain an identifier of a first one of registers 286, bits 10:8 contain an identifier of a second one of registers 286, bits 7:5 contain an number of bits to shift or an identifier of a third one of registers 286, bits 4:2 contain an identifier of a destination one of registers 286; and bits 1:0 contain ALU control bits. The ALU control bits may be abbreviated herein as "ACC." As will be discussed in greater detail below, ALU control bits control the operation of an ALU instruction.

The set of ALU instructions used by processing element 34A may include the following instructions:

MULTSS:

Syntax: MULTSS $R_x$, $R_y$, shift, $R_z$, ACC

Function: Causes control unit 280 to output control signals that instruct ALU 282 to perform a multiplication of the signed values in registers $R_x$ and $R_y$, and then shifts product left by the amount specified by "shift." After shifting the product, ALU 282 extracts the bits specified by the ACC from the product. ALU 282 then outputs these bits. If ACC=0, ALU 282 extracts the lower 32 bits of the product. If ACC=1, ALU 282 extracts the middle 32 bits of the product. If ACC=2, ALU 282 extracts the higher 32 bits of the product. This instruction also causes control unit 280 to output control signals to multiplexer 284 to direct output from ALU 282 to $R_z$ in registers 286.

MULTSU:

Syntax: MULTSU $R_x$, $R_y$, shift, $R_z$, ACC

Function: Causes control unit 280 to output control signals that instruct ALU 282 to perform multiplication of a signed value in $R_x$ and an unsigned value in $R_y$, and then shift the product left by the amount specified by "shift." After shifting the product, ALU 282 extracts the bits specified by the ACC from the product. ALU 282 then outputs these bits. If ACC=0, ALU 282 extracts the lower 32 bits of the product. If ACC=1, ALU 282 extracts the middle 32 bits of the product. If ACC=2, ALU 282 extracts the higher 32 bits of the product. This instruction also causes control unit 280 to output control signals to multiplexer 284 to direct output from ALU 282 to $R_z$ in registers 286.

MULTUU:

Syntax: MULTUU $R_x$, $R_y$, shift, $R_z$, ACC

Function: Causes control unit 280 to output control signals that instruct ALU 282 to perform an multiplication of unsigned values in registers $R_x$ and $R_y$, and then shift the product left by the amount specified by "shift." After shifting the product, ALU 282 extracts the bits specified by the ACC from the product. ALU 282 then outputs these bits. If ACC=0, ALU 282 extracts the lower 32 bits of the product and stores these 32 bits in $R_z$. If ACC=1, ALU 282 extracts the middle 32 bits of the product. If ACC=2, ALU 282 extracts the higher 32 bits of the product. This instruction also causes control unit 280 to output control signals to multiplexer 284 to direct output from ALU 282 to $R_z$ in registers 286.

MACSS:

Syntax: MACSS $R_x$, $R_y$, shift, $R_z$, ACC

Function: Causes control unit 280 to output control signals that instruct ALU 282 to perform a multiplication of signed values in registers $R_x$ and $R_y$, and then shifts the product left by the amount specified by "shift." After shifting the product, ALU 282 extracts from the product the 32 bits specified by the ACC and then adds these 32 bits to the value in $R_z$ and outputs the resulting bits. If ACC=0, ALU 282 extracts the lower 32 bits of the product. If ACC=1, ALU 282 extracts the middle 32 bits of the product. If ACC=2, ALU 282 extracts the higher 32 bits of the product. This instruction also causes control unit 280 to output control signals to multiplexer 284 to direct output from ALU 282 to $R_z$ in registers 286.

MACSU

Syntax: MACSU $R_x$, $R_y$, shift, $R_z$, ACC

Function: Causes control unit 280 to output control signals that instruct ALU 282 to perform a multiplication of a signed value in $R_x$ and an unsigned value in $R_y$, and then shift the product left by the amount specified by "shift." After shifting the product, ALU 282 extracts from the product the 32 bits specified by the ACC. ALU 282 then adds these 32 bits to the value in $R_z$ and outputs the resulting bits. If ACC=0, ALU 282 extracts the lower 32 bits of the product. If ACC=1, ALU 282 extracts the middle 32 bits of the product. If ACC=2, ALU 282 extracts the higher 32 bits of the product. This instruction also causes control unit 280 to output control signals to multiplexer 284 to direct output from ALU 282 to $R_z$ in registers 286.

MACUU

Syntax: MACUU $R_x$, $R_y$, shift, $R_z$, ACC

Function: Causes control unit 280 to output control signals that instruct ALU 282 to perform a multiplication of unsigned values in registers $R_x$ and $R_y$, and then shift the product left by the amount specified by "shift." After shifting the product, ALU 282 extracts from the product the 32 bits specified by the ACC and then adds these 32 bits to the value in $R_z$. ALU 282 then outputs the resulting bits. If ACC=0, ALU 282 extracts the lower 32 bits of the product. If ACC=1, ALU 282 extracts the middle 32 bits of the product. If ACC=2, ALU 282 extracts the higher 32 bits of the product. This instruction also causes control unit 280 to output control signals to multiplexer 284 to direct output from ALU 282 to $R_z$ in registers 286.

MULTUUMIN

Syntax: MULTUUMIN $R_x$, $R_y$, shift, $R_z$, ACC

Function: Causes control unit 280 to output control signals that instruct ALU 282 to perform a multiplication of unsigned values in registers $R_x$ and $R_y$, and then shift the product to the left by the amount specified by "shift." ALU 282 then extracts from the product the bits specified by the ACC and determines whether these bits represent a number that is less than a number stored in $R_z$. If these bits represent a number that is less than the number stored in $R_z$, ALU 282 outputs these bits. If ACC=0, ALU 282 extracts the lower 32 bits of the product. If ACC=1, ALU 282 extracts the middle 32 bits of the product. If ACC=2, ALU 282 extracts the higher 32 bits of the product. This instruction also causes control unit 280 to output control signals to multiplexer 284 to direct output from ALU 282 to $R_z$ in registers 286.

MACSSD

Syntax: MACSSD $R_x$, $R_y$, shift, $R_z$, ACC

Function: Causes control unit 280 to output control signals that instruct ALU 282 to perform a multiplication of signed values in registers $R_x$ and $R_y$, and then shift the product left by the amount specified by "shift." ALU 282 then extracts from the product the 32 bits specified by the ACC. After extracting these bits from the product, ALU 282 adds these 32 bits to the value stored in the register that follows $R_z$ (i.e., $R_{z+1}$). After adding these values, ALU 282 outputs the sum. If ACC=0, ALU 282 extracts the lower 32 bits of the product. If ACC=1, ALU 282 extracts the middle 32 bits of the product. If ACC=2, ALU 282 extracts the higher 32 bits of the product. This instruction also causes control unit 280 to output control signals to multiplexer 284 to direct output from ALU 282 to $R_z$ in registers 286.

MACSUD

Syntax: MACSSD $R_x$, $R_y$, shift, $R_z$, ACC

Function: Causes control unit 280 to output control signals that instruct ALU 282 to perform a multiplication of a signed value in register $R_x$ and unsigned value in register $R_y$, and then shift the product left by the amount specified by "shift." ALU 282 then extracts from the product the 32 bits specified by the ACC. After extracting these bits from the product, ALU 282 adds these 32 bits to the value stored in the register that follows $R_z$ (i.e., $R_{z+1}$). After adding these values, ALU 282 outputs the sum. If ACC=0, ALU 282 extracts the lower 32 bits of the product. If ACC=1, ALU 282 extracts the middle 32 bits of the product. If ACC=2, ALU 282 extracts the higher 32 bits of the product. This instruction also causes control unit 280 to output control signals to multiplexer 284 to direct output from ALU 282 to $R_z$ in registers 286.

MACUUD

Syntax: MACSSD $R_x$, $R_y$, shift, $R_z$, ACC

Function: Causes control unit 280 to output control signals that instruct ALU 282 to perform a multiplication of unsigned values in registers $R_x$ and $R_y$, and then shift the product left by the amount specified by "shift." ALU 282 then extracts from the product the 32 bits specified by the ACC. After extracting these bits from the product, ALU 282 adds these 32 bits to the value stored in the register that follows $R_z$ (i.e., $R_{z+1}$). After adding these values, ALU 282 outputs the sum. If ACC=0, ALU 282 extracts the lower 32 bits of the product. If ACC=1, ALU 282 extracts the middle 32 bits of the product. If ACC=2, ALU 282 extracts the higher 32 bits of the product. This instruction also causes control unit 280 to output control signals to multiplexer 284 to direct output from ALU 282 to $R_z$ in registers 286.

MASSS

Syntax: MASSS $R_x$, $R_y$, shift, $R_z$, ACC

Function: Causes control unit 280 to output control signals that instruct ALU 282 to perform a multiplication of signed values in registers $R_x$ and $R_y$, and then shift the product left by the amount specified by "shift." ALU 282 then extracts from the product the 32 bits specified by the ACC. After extracting the bits, ALU 282 subtracts these bits from the value in $R_z$ and outputs the resulting bits. If ACC=0, ALU 282 extracts the lower 32 bits of the product. If ACC=1, ALU 282 extracts the middle 32 bits of the product. If ACC=2, ALU 282 extracts the higher 32 bits of the product. This instruction also causes control unit 280 to output control signals to multiplexer 284 to direct output from ALU 282 to $R_z$ in registers 286.

MASSU

Syntax: MASSS $R_x$, $R_y$, shift, $R_z$, ACC

Function: Causes control unit 280 to output control signals that instruct ALU 282 to perform a multiplication of a signed value in register $R_x$ and an unsigned value in register $R_y$, and then shift the product left by the amount specified by "shift." ALU 282 then extracts from the product the 32 bits specified by the ACC. After extracting the bits, ALU 282 subtracts these bits from the value in $R_z$ and outputs the resulting bits. If ACC=0, ALU 282 extracts the lower 32 bits of the product. If ACC=1, ALU 282 extracts the middle 32 bits of the product. If ACC=2, ALU 282 extracts the higher 32 bits of the product. This instruction also causes control unit 280 to output control signals to multiplexer 284 to direct output from ALU 282 to $R_z$ in registers 286.

MASUU

Syntax: MASUU $R_x$, $R_y$, shift, $R_z$, ACC

Function: Causes control unit 280 to output control signals that instruct ALU 282 to perform a multiplication of unsigned values in registers $R_x$ and $R_y$, and then shift the product left by the amount specified by "shift." The control signals also cause ALU 282 to extract from the product the 32 bits specified by the ACC. After extracting the bits, ALU 282 subtracts these bits from the value in $R_z$ and outputs the resulting value. If ACC=0, ALU 282 extracts the lower 32 bits of the product. If ACC=1, ALU 282 extracts the middle 32 bits of the product. If ACC=2, ALU 282 extracts the higher 32 bits of the product. This instruction also causes control unit 280 to output control signals to multiplexer 284 to direct output from ALU 282 to $R_z$ in registers 286.

EGCOMP

Syntax: EGCOMP $R_x$, $R_y$, shift, $R_z$, ACC

Function: Causes control unit 280 to select an operation based on a control word of a set of voice parameters that define a MIDI voice that processing element 34A is currently processing. The EGCOMP instruction also causes control unit 280 to output control signals that instruct ALU 282 to perform the selected operation. In the first mode, ALU 282 adds the value in $R_x$ with the value in $R_y$ and outputs the resulting sum. In the second mode, ALU 282 performs an unsigned multiplication of the value in $R_x$ and the value in $R_y$, shifts the product left by the amount specified in shift, and then outputs the most significant thirty-two (32) bits of the shifted product. In the third mode, ALU 282 outputs the value in $R_x$. In the fourth mode, ALU 282 outputs the value of $R_y$. In the context of the EGCOMP instruction, an ACC value of zero may cause control unit 280 to output a control signal to instruct ALU 282 to calculate a new value for a volume envelope of the current MIDI voice. An ACC value of one may cause control unit 280 to output a control signal to instruct ALU 282 to calculate a new modulation envelope for the current MIDI voice. The EGCOMP instruction also causes control unit 280 to output control signals to multiplexer 284 to direct output from ALU 282 to $R_z$ in registers 286.

Before performing the operations in the EGCOMP instruction associated with a mode, ALU 282 first calculates the mode. For example, ALU 282 may calculate the mode using the following equation:

$$\text{Mode}=vps.\text{ControlWord}((ACC*8+\text{second_loop_counter}(1{:}0)*2+1):(ACC*8+\text{second_loop_counter}(1{:}0)*2))$$

In other words, the value of "mode" equals two bits in the control word of the current voice parameter set. The index of the more significant one of those two bits may be determined by performing the following steps:

(1) Generating a first product by multiplying the value of ACC by eight (i.e., shifting a bitwise representation of the value of ACC left by three places).

(2) Generating a second product by multiplying the two least significant bits of the second loop counter by two (i.e., shifting a bitwise representation of the value of ACC left by one place).

(3) Adding the first product, the second product, and the number one.

The index of the less significant one of the two bits of the control word may be determined by performing the same steps except without adding the number one in the third step. For example, the control word may equal 0x0000807 (i.e., 0b0000 0000 0000 0000 0100 0000 0111). Furthermore, the value of ACC may be 0b0001 and the value of the second loop counter may be 0b0001. In this example, the index of the more significant bit of the control word is 0b0<u>0001</u>011 (i.e., the number eleven in decimal) and the index of the less significant bit of the control word is 0b0<u>0001</u>010 (i.e., the number ten in decimal). In the previous sentence, the bits of the index values that are underlined represent bits from the ACC and the bits of the index values that are italicized represent bits from the second loop counter. Therefore, the mode is 01 (i.e., the number one in decimal) because the values 0 and 1 are at locations 11 and 10, respectively, of the control word. Because the mode is 01, ALU 282 performs an unsigned multiplication of the value in $R_x$ and the value in $R_y$, shifts the product left by the amount specified in shift, and then outputs the most significant thirty-two (32) bits of the shifted product.

Envelope generation is a method of modeling volume or modulation qualities of individual musical notes. Each musical note may have several phases. For example, a musical note may have a delay phase, an attack phase, a hold phase, a decay phase, a sustain phase, and a release phase. The delay phase may define an amount of time prior to the onset of the attack phase. During the attack phase, a volume or modulation level is increased to a peak level. During the hold phase, the volume or modulation level is maintained at the peak level. During the decay phase, the volume or modulation level is decreased to a sustain level. During the sustain level, the volume or modulation level is maintained at a sustain level. During the release phase, the volume or modulation level decreases to zero. Furthermore, changes in the volume or module level may be linear or exponential. The length of an envelope generation phase may be defined in terms of sub-frames. The term "sub-frame" may refer to one-fourth of a MIDI frame. For example, if a MIDI frame is 10 milliseconds, a sub-frame is 2.5 milliseconds. For example, an attack phase of a MIDI voice may last one sub-frame, a decay phase of the MIDI voice may last one sub-frame, and a sustain phase of a MIDI voice may last two sub-frames.

The EGCOMP instruction performs operations to perform envelope generation. For example, an addition operation (i.e., mode 00) may correspond to a linear ramp up (e.g., during the attack phase) or down (i.e., during the decay or release phase) of the volume or modulation level during a sub-frame. A multiplication operation (i.e. mode 01) may correspond to an exponential ramp up or ramp down (i.e., during the decay or release phase) of the volume or modulation level during a sub-frame. The assignment operations (i.e., modes 10 and 11) may correspond to a sustain of the volume or modulation intensity during a sub-frame. In the control word, bits 1:0 may indicate which EGCOMP mode to use in a first sub-frame for volume; bits 3:2 may indicate which EGCOMP mode to use in a second sub-frame for volume; bits 5:4 may indicate which EGCOMP mode to use in a third sub-frame for volume; bits 7:6 may indicate which EGCOMP mode to use in a fourth sub-frame for volume; bits 9:8 may indicate which EGCOMP mode to use in a first sub-frame for modulation; bits 11:10 may indicate which EGCOMP mode to use in a second sub-frame for modulation; bits 13:12 may indicate which EGCOMP mode to use in a third sub-frame for modulation; and bits 15:14 may indicate which EGCOMP mode to use in a fourth sub-frame for modulation.

Load/store instructions are instructions to read or write information from or to one of several modules external to processing element 34A. When control unit 280 encounters a load/store instruction, control unit 280 blocks until the load/store instruction is complete. In one exemplary format, each load/store instruction is eighteen bits long. For example, bits 17:16 of a load/store instruction are reserved, bits 15:13 contain an load/store instruction identifier, bits 12:6 contain a load source or a store destination address, bits 5:3 contain an identifier of a first one of registers 286, and bits 2:0 contain an identifier of a second one of registers 286.

The set of load/store instructions used by processing element 34A may include the following instructions:

LOADDATA

Syntax: LOADDATA address, $R_y$, $R_z$.

Function: If $R_y$ equals $R_z$, loads $R_y$ is with the value at address. If address is even, loads the registers $R_y$ and $R_z$ with the values at address and (address+1), respectively. If address is odd, loads $R_y$ and $R_z$ with the value at (address−1) and address, respectively.

STOREDATA

Syntax: STOREDATA address, $R_y$, $R_z$.

Function: If $R_y$ equals $R_z$, stores the value of $R_y$ to address. If address is even, stores values at $R_y$ and $R_z$ at address and (address+1), respectively. If address is odd, stores values at $R_y$ and $R_z$ at (address−1) and address, respectively.

LOADSUM

Syntax: LOADSUM $R_x$, $R_y$.

Function: Loads into registers $R_y$ and $R_z$ a value in summing buffer 40 indicated by a sample count. The sample count used in the LOADSUM instruction is the same count used the STORESUM instruction described below.

LOADFIFO

Syntax: LOADFIFO fifo_low_high, fifo_signed_unsigned, $R_x$.

Function: Removes a value from a head of WFU interface FIFO 298 and stores the value in $R_x$. The one of registers 286 into which the value is loaded and how the value is loaded into the register depends on the fifo_low_high flag and the fifo_signed_unsigned flags. If fifo_low_high is 0, then the value is loaded into the lower 16 bits of $R_x$. If fifo_low_high is 1, then the value is loaded into the higher 16 bits of $R_x$. If fifo_signed_unsigned is 0, then the value is stored as an unsigned number. If fifo_signed_unsigned is 1, then the value is stored as a signed number and the value is signed-extended to 32 bits. However, if the fifo_low_high flag is set to 1, the fifo_signed_unsigned flag has no effect.

STOREWFU

Syntax: STOREWFU $R_x$.

Function: Sends the value in $R_x$ to WFU 36.

STORESUM

Syntax: STORESUM acc_sat_mode, $R_x$, $R_y$.

Function: Stores values in registers $R_x$ and $R_y$ to summing buffer 40. In addition, this instruction sends a sample counter that implicitly depends on the first and the second loop counters. The sample counter describes which sample of the digital waveform is currently being processed by processing element 34A. When control unit 280 receives a reset command from coordination module 32, control unit 280 initializes the value to zero. Subsequently, control unit 280 increments the sample counter by one each time control unit 280 encounters a STORESUM instruction. Control unit 280 may output the sample counter as a control signal to summing buffer 40. The acc_sat_mode parameter may define whether summing buffer 40 saturates the value for the sample. Saturation may occur when the value for the sample rises above a highest number or falls below a lowest number that may be stored for the sample. If saturation is enabled, summing buffer 40 may maintain the value at the highest number or lowest number when adding the values of $R_x$ and $R_y$ would cause the value for the sample to rise above or fall below the highest or lowest number that may be represented for the sample. If saturation is not enabled, summing buffer 40 may roll over the number for the sample when adding the values of $R_x$ and $R_y$. In addition, the acc_sat_mode parameter may determine whether summing buffer 40 replaces the value for the sample with values in registers $R_x$ and $R_y$ or adds the values in registers $R_x$ and $R_y$ to the value for the sample in summing buffer 40. The following chart may illustrate an exemplary operation of the acc_sat_mode parameter:

| Acc_Sat_Mode(2 bits) | Function |
|---|---|
| 00 | No Accumulation; no Saturation |
| 01 | No Accumulation; saturates the inputs and stores. |
| 10 | Accumulates the inputs with existing elements in sum-buffer ram. No saturation is performed on the accumulated output. |
| 11 | Accumulates the inputs with existing elements in sum-buffer ram. The output is saturated before it is stored back to summing buffer 40. |

LOADLFO

Syntax: LOADLFO lfo_id, lfo_update, $R_x$ where

{lfo_id}=type of LFO to be read: 2-bits

00: modLfo→pitch

01: modLfo→gain

10: modLfo→frequency corner

11: vibLfo→pitch

{lfo_update}=which parameter to update after the current output: 2-bits

00: no update

01: only update LFO values

10: only update LFO phase

11: update both LFO values and phase.

Function: Loads a value from LFO 38 having an identifier specified by "lfo_id" to $R_x$. In addition, this instruction instructs LFO 38 which parameter to update after loading the value to $R_x$.

As discussed above, LFO 38 may generate one or more precise triangular digital waveforms. For each one of processing elements 34, LFO 38 may provide four output values: a modulate pitch value, a modulate gain value, a modulate frequency corner value, and a vibrato pitch value. Each of these output values may represent a variation on the triangular digital waveform.

When control unit 280 reads the LOADLFO instruction, control unit 280 may output to LFO 38 control signals that represent the "lfo_id" parameter. The control signals that represent the "lfo_id" parameter may instruct LFO 38 to send a value in one of the output values to interface FIFO 296 in processing element 34A. For example, if control unit 280 sends control signals that represent the value 01 for the "lfo_id", LFO 38 may send the value of the modulation gain output value. In addition, control unit 280 may output control signals to multiplexer 284 to direct output from interface FIFO 296 to the register $R_z$ in registers 286.

Furthermore, when control unit 280 reads the LOADLFO instruction, control unit 280 may output control signals to LFO 38 that represent the "lfo_update" parameter. The control signals that represent the "lfo_update" parameter instruct LFO 38 how to update the output values. When LFO 38 receives the control signals that represent the "lfo_update"

parameter, LFO 38 may select an operation to perform based on the set of voice parameters of the MIDI voice that processing element 34A is currently processing. For example, LFO 38 may use a control word of the voice parameter set to determine whether LFO 38 is in a "delay" state or a "generate" state.

To determine whether LFO 38 is in a "delay" state or a "generate" state, LFO 38 may access bits of a control word of the voice parameter set stored in VPS RAM 46A. For example, bits 23:16 of the control word may determine whether an LFO is in a "generate" mode or a "delay" state. In the "generate" state, LFO 38 may multiply a parameter for pitch. In the "delay" state, LFO 38 does not multiply the parameter for pitch. For instance, bit 16 of the control word may indicate whether the modulate mode of LFO 38 is in delay or generate state for the first sub-frame of the current MIDI frame; bit 17 may indicate whether the modulate mode LFO 38 is in delay or generate state for the second sub-frame of the current MIDI frame; bit 18 may indicate whether the modulate mode LFO 38 is in delay or generate state for the third sub-frame of the current MIDI frame; bit 19 may indicate whether the modulate mode LFO 38 is in delay or generate state for the fourth sub-frame of the current MIDI frame.

In addition, bit 20 of the control word may indicate whether the vibrato mode of LFO 38 is in a delay or generate state for a first sub-frame of the current MIDI frame; bit 21 of the control word may indicate whether the vibrato mode of LFO 38 is in a delay or generate state for a second sub-frame of the current MIDI frame; bit 22 of the control word may indicate whether the vibrato mode of LFO 38 is in a delay or generate state for a third sub-frame of the current MIDI frame; and bit 23 of the control word may indicate whether the vibrato mode of LFO 38 is in a delay or generate state for a fourth sub-frame of the current MIDI frame;

After selecting the operation (i.e., whether to execute in the "delay" mode or the "generate" mode), LFO 38 may perform the selected operation. If LFO 38 is in a delay state, LFO 38 may store a bias value for the mode of LFO identified by the "lfo_id" parameter into an output register of LFO 38 for the mode. On the other hand, if LFO 38 is in a generate state, LFO 38 may first determine whether the value of the "lfo_update" parameter equals 2 or 3. If the value of "lfo_update" equals 2 or 3, LFO 38 may update LFO phase or update LFO values and phase. If the value of the "lfo_update" parameter equals 2 or 3, LFO 38 may update a phase of the LFO by adding an LFO ratio to the current phase of the LFO. Next, LFO 38 may determine whether the value of the "lfo_update" parameter equals 1 or 3. If the value of "lfo_update" equals 1 or 3, LFO 38 may calculate an updated value for LFO output register identified by the "lfo_id" parameter by multiplying a current sample in LFO 38 by a gain and adding a bias value.

The following example pseudo-code may summarize the operation of the LOADLFO instruction:

```
Rx = peLfoOut[lfoID];
Switch(lfoState) {
  Case DELAY:
    peLfoOut[lfoID] = bias[lfoID];
    break;
  GENERATE:
    if (lfoUpdate == 2 || lfoUpdate == 3) {
      lfoCur = lfoCur + lfoRatio;
    }
    if (lfoUpdate == 1 || lfoUpdate == 3) {
      // upper 16-bits of lfoCur
      lfoSample = lfoCur[31:16];
```

-continued

```
      if(lfoSample>0) {
        lfoGain = positiveSideGain[lfoID];
      }
      else {
        lfoGain = negativeSideGain[lfoID];
      }
      peLfoOut[lfoID] = bias[lfoID] +
    lfoSample*lfoGain;
      break;
    }
}
```

This example pseudo-code is not meant to represent software instructions performed by processing element 34A and LFO 38. Rather, this pseudo-code may describe operations performed in the hardware of processing elements 34A and LFO 38.

Control instructions are instructions to control the behavior of control unit 280. In one exemplary format, each control instruction is sixteen bits long. For example, bits 15:13 contain a control instruction identifier, bits 12:4 contain a memory address, and bits 3:0 contain a mask for the control.

The set of control instructions used by processing element 34A may include the following instructions:

JUMPD

Syntax: JUMPD address, mask.

Function: Instruction causes control unit 280 to load program counter 290 with the value of [address] if a bitwise AND operation of [mask] and bits 27:24 of the control word in VPS RAM unit 46A evaluates to a non-zero value. Bit 27 of the control word may indicate whether a waveform is looped. Bit 26 of the control word may indicate whether a waveform is eight or sixteen bits wide. Bit 25 of the control word may indicate whether a waveform is stereo. Bit 24 of the control word may indicate whether a filter is enabled. Because control unit 280 may already have loaded an instruction following a JUMPD instruction, the update to the value of program counter 290 may become effective following the instruction that follows the JUMPD instruction.

JUMPND

Syntax: JUMPND address, mask

Function: Instruction causes control unit 280 to load program counter 290 with the value of [address] if a bitwise AND operation of [mask] and bits 27:24 of the control word in VPS RAM unit 46A evaluates to a zero value. The result of the bitwise AND operation evaluates to false when the result does not contain a 1. Because control unit 280 may already have loaded an instruction following a JUMPND instruction, the update to the value of program counter 290 may become effective following the instruction that follows the JUMPND instruction.

LOOP1BEGIN

Syntax: LOOP1BEGIN count

Function: Initiates the start of a first loop. Control unit 280 sets the value of program counter 290 to the memory address of the instruction following a LOOP1BEGIN instruction when control unit 280 encounters a LOOP1ENDD instruction [count] plus one number of times. In addition, control unit 280 sets the value of first loop counter 304 equal to [count]. For example, when control unit 280 encounters the instruction "LOOP1BEGIN 119", control unit 280 sets the value of program counter 290 to the memory address of the instruction following the LOOP1BEGIN instruction 120 times.

LOOP1ENDD

Syntax: LOOP1ENDD

Function: The instruction after LOOP1ENDD is the last instruction in the first loop. Control unit 280 determines whether the value of first loop counter 304 is greater than zero. If the value of first loop counter 304 is greater than zero, control unit 280 decrements the value of first loop counter 304 and sets the value of program counter 290 to the memory address of instruction that follows the LOOP1BEGIN instruction. Otherwise, if the value of first loop counter 304 is not greater than zero, control unit 280 merely increments the value of program counter 290.

LOOP2BEGIN

Syntax: LOOP2BEGIN count.

Function: Initiates the start of a second loop. Control unit 280 sets the value of program counter 290 to the memory address of the instruction following a LOOP2BEGIN instruction when control unit 280 encounters a LOOP2ENDD instruction [count] plus one number of times. In addition, control unit 280 sets the value of second loop counter 306 equal to [count].

LOOP2ENDD

Syntax: LOOP2ENDD

Function: The instruction after LOOP2ENDD is the last instruction in the second loop. Control unit 280 decrements second loop counter 306 and sets the value of program counter 290 to the memory address of the LOOP2BEGIN instruction if the second loop counter is not zero.

CTRL_NOP

Syntax: CTRL_NOP

Function: Control unit 280 does nothing.

EXIT

Syntax: EXIT

Function: When control unit 280 encounters the EXIT instruction, control unit 280 outputs a control signal to coordination module 32 to inform coordination module 32 that processing element 34A has completed generation of an overall digital waveform of a MIDI frame. After sending the control signal, control unit 280 may wait until coordination module 32 sends a signal to control unit 280 to reset the value of program counter 290 to an initial value (e.g., to zero).

Before processing element 34A begins generating a digital waveform for a MIDI voice, coordination module 32 may send a reset signal to control unit 280. When control unit 280 receives the reset signal from coordination module 32, control unit 280 may reset the values of first loop counter 304, second loop counter 306, and program counter 290 to their initial values. For example, control unit 280 may set the values of first loop counter 304, second loop counter 306, and program counter 290 to zero.

Subsequently, coordination module 32 may send an enable signal to control unit 280 to instruct processing element 34A to begin generating a digital waveform for the MIDI voice described in VPS RAM unit 46A. When control unit 280 receives the enable signal, processing element 34 may begin executing a series of program instructions (i.e., a program) stored in consecutive memory locations in program RAM unit 44A. Each of the program instructions in program RAM unit 44A may be instances of instructions in the set of instructions described above.

In general, the program executed by processing element 34A may consist of a first loop and a second loop nested within the first loop. During each cycle of the first loop, processing element 34A may perform the entire second loop until the second loop terminates. When the second loop terminates, processing element 34A may have derived a symbol for one sample of a waveform for the MIDI voice. When the first loop terminates, processing element 34A has derived each symbol for each sample of the waveform for a MIDI voice for an entire MIDI frame. For example, the following series of instructions in the above example instruction set may outline a basic structure of a program executed by processing element 34A:

```
LOOP1BEGIN firstLoopcounter
...
LOOP2BEGIN secondLoopCounter
// derive symbol for a sample
...
LOOP2ENDD
CTRL_NOP
// perform additional processing
...
LOOP1ENDD
CTRL_NOP
// perform additional processing
...
EXIT
```

In this example series of instructions, words preceded by a double forward slash represent one or more instructions to perform the operation described. Furthermore, in this example, CTRL_NOP operations follow the LOOP1ENDD and LOOP2ENDD instructions because control unit 280 may have already begun execution of the instruction that follows a LOOP1ENDD or a LOOP2ENDD instruction before control unit 280 uses the updated memory address in program counter 290 to access a location in program RAM 34A that contains the respective LOOP1BEGIN or LOOP2BEGIN instructions. In other words control unit 280 may have already added the instruction following a loop end instruction to a processing pipeline.

To execute the program in program RAM unit 44A, control unit 280 may send a request to program RAM unit 44A to read a memory location in program RAM unit 44A having the memory address stored in program counter 290. In response to the request, program RAM unit 44A may send to control unit 280 the content of the memory location in program RAM unit 44A having the memory address stored in program counter 290.

The content of the requested memory location may be a forty-bit word that includes two program instructions that processing element 34A may execute in parallel. For example, one memory location in program RAM unit 44A may include one of:

(1) an ALU instruction and a load/store instruction in one word;

(2) a load/store instruction and a second load/store instruction in one word;

(3) a control instruction and a load/store instruction in one word; or (4) an ALU instruction and a control instruction in one word.

In a word that includes an ALU instruction and a load/store instruction, bits 0: 17 may be the load/store instruction, bits 18:37 may be the ALU instruction, and bits 38 and 39 may be a flag that indicates that the word contains an ALU instruction and a load/store instruction. In a word that includes two load instructions, bits 0:17 may be the first load/store instruction, bits 18 and 19 may be reserved, bits 20:37 may be the second load/store instruction, and bits 38 and 39 may be a flag that indicates that the word contains two load/store instructions. In a word that includes a control instruction and a load instruction, bits 0:17 may be a load instruction, bits 18 and 19 may be reserved, bits 20:35 may be the control instruction, bits 36 and 37 may be reserved, and bits 38 and 39 may be a flag that indicates that the word contains a control instruction and a load/store instruction. In a word that includes an ALU instruction and a control instruction, bits 0:15 may be the control instruction, bits 16 and 17 may be reserved, bits 18:37 may be the ALU instruction, and bits 38 and 39 may be a flag that indicates that the word contains an ALU instruction and a control instruction.

After receiving the content of the memory location, control unit 280 may decode and apply the instructions specified in the content of the memory location. Control unit 280 may decode and apply each of the instructions atomically. In other words, once control unit 280 begins executing an instruction, control unit 280 does not change any data that is used or effected by the instruction until control unit 280 finishes executing the instruction. Furthermore, in some examples, control unit 280 may decode and apply in parallel both instructions in a word received from program RAM unit 44A. Once control unit 280 has executed the instructions in a word, control unit 280 may increment program counter 290 and request the content of the memory location in program RAM unit 44A identified by the incremented program counter.

The use of a specialized instruction set for processing elements 34 may provide one or more advantages. For example, various audio processing operations are performed to generate digital waveforms. In a first approach, the audio processing operations may be implemented in hardware. For instance, an application-specific integrated circuit (ASIC) could be designed to implement these operations. However, implementing these operations in hardware prevents the re-use of such hardware for other purposes. That is, once an ASIC designed to implement these operations has been installed in a device, the ASIC generally cannot be changed to perform different operations. In a second approach, a processor that uses a general-purpose instruction set may perform the audio processing operations. However, the use of such a processor may be wasteful. For instance, a processor that uses a general-purpose instruction set may include circuitry to decode instructions that are never used in the generation of digital waveforms. The use of a specialized instruction set may resolve the weaknesses of these two approaches. For example, the use of a specialized instruction set may allow updates a program that uses the instructions to generate the digital waveforms. At the same time, the use of a specialized instruction set may allow a chip designer to keep the implementation of the processor simple.

Furthermore, the use of specialized instructions, such as EGCOMP and LOADLFO, that perform different functions based on values in a voice parameter set may provide one or more additional advantages. For example, because EGCOMP and LOADLFO are implemented as single instructions, there is no need for conditional jumps or branches to execute these instructions. Because EGCOMP and LOADLFO do not include conditional jumps or branches, there is no need to update the program counter during these conditional jumps or branches. Furthermore, because EGCOMP and LOADLFO are implemented as single instructions, there is no need to load separate instructions to perform the operations of EGCOMP and LOADLFO. For example, case 1 of the EGCOMP instruction requires a multiplication operation. However, because EGCOMP is a single instruction, there is no need to load a separate multiplication operation from program memory. Because EGCOMP and LOADLFO do not require multiple loads from program memory, EGCOMP and LOADLFO may be perform in fewer clock cycles than if EGCOMP and LOADLFO had been implemented as sets of separate instructions.

In another example, the use of specialized instructions that perform different functions based on values of a voice parameter set may be advantageous because programs using such instructions may be more compact. For instance, it may require ten separate instructions to implement the operation performed by one EGCOMP instruction. A more compact program may be easier for a programmer to read. In addition, a more compact program may occupy less space in program memory. Because a more compact program may occupy less space in program memory, program memory may be smaller. A smaller program memory may be less expensive to implement and may conserve space on a chipset.

Figure 13:
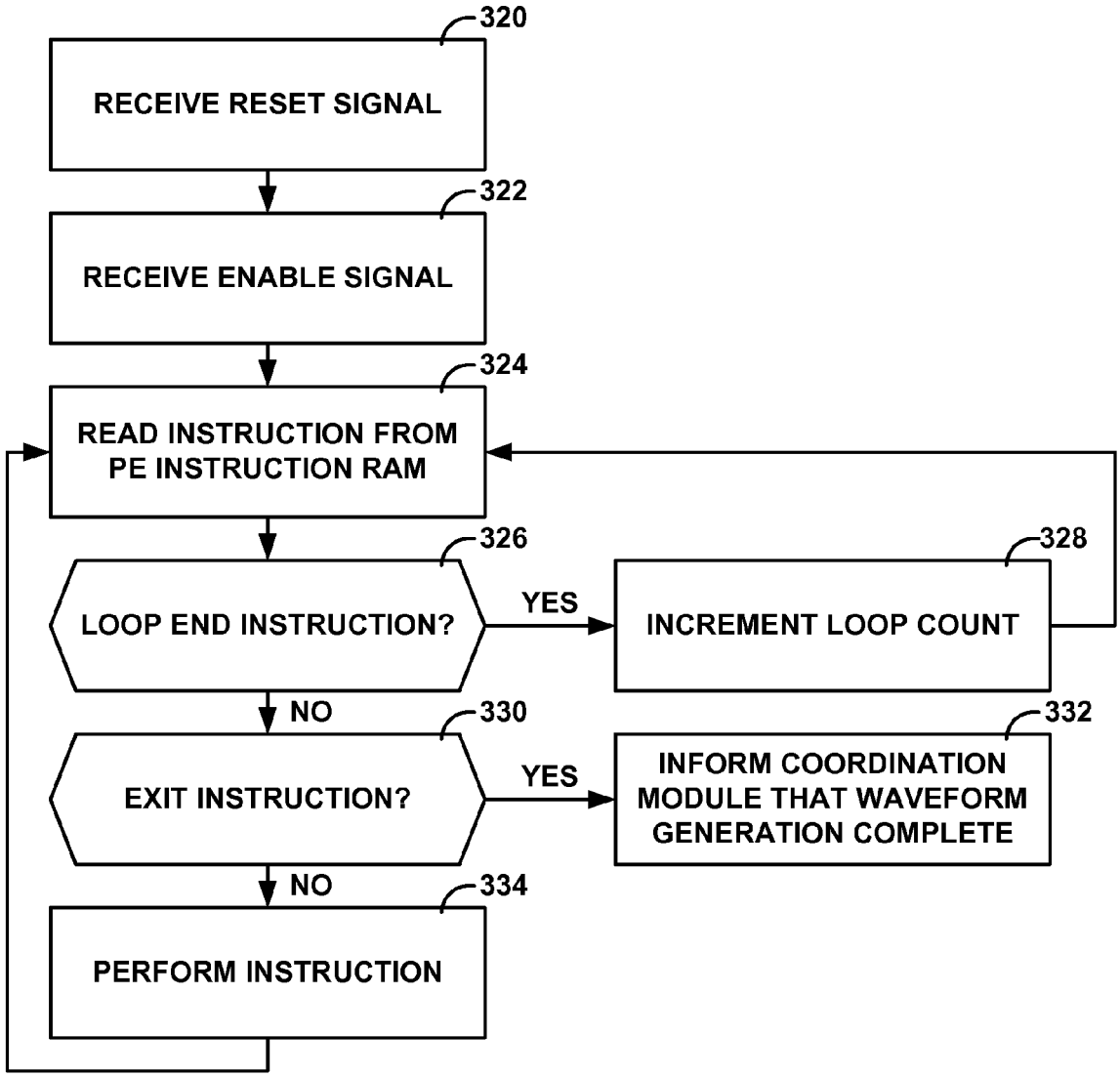
FIG. 13 is a flowchart illustrating an example operation of the processing element in the MIDI hardware unit of the audio device.

FIG. 13 is a flowchart illustrating an example operation of processing element 34A in MIDI hardware unit 18 of audio device 4. While the example of FIG. 13 is explained with reference to processing element 34A, each of processors 34 may perform this operation simultaneously.

Initially, control unit 280 in processing element 34A may receive a control signal from coordination module 32 to reset the values of internal registers in order to prepare to generate a new digital waveform for a MIDI voice (320). When control unit 280 receives the reset signal, control unit 280 may reset the values of first loop counter 304, second loop counter 306, program counter 290, and registers 286 to zero.

Next, control unit 280 may receive an instruction from coordination module 32 to start generating a digital waveform for the MIDI voice having parameters in VPS RAM unit 46A (322). After control unit 280 receives an instruction from coordination module 32 to start generating a digital waveform for the MIDI voice, control unit 280 may read a program instruction from program memory 44A (324). Control unit 280 may then determine whether the program instruction is a "Loop End" instruction (326). If the instruction is a "Loop End" instruction ("YES" of 326), control unit 280 may decrement a loop count value in a register in processing element 34A (328). On the other hand, if the instruction is not a "Loop End" instruction ("NO" of 326), control unit 280 may determine whether the instruction is an "EXIT" instruction (330). If the instruction is an "EXIT" instruction ("YES" of 330), control unit 280 may output a control signal that informs coordination module 32 that processing element 34A has finished generating a digital waveform for the MIDI voice (332). If the instruction is not an "EXIT" instruction ("NO" of 330), control unit 280 may output control signals or change the value of program counter 290 to cause the performance the instruction (334).

Various examples have been described. One or more aspects of the techniques described herein may be implemented in hardware, software, firmware, or combinations thereof. Any features described as modules or components may be implemented together in an integrated logic device or separately as discrete but interoperable logic devices. If implemented in software, one or more aspects of the techniques may be realized at least in part by a computer-readable medium comprising instructions that, when executed, performs one or more of the methods described above. The computer-readable data storage medium may form part of a computer program product, which may include packaging materials. The computer-readable medium may comprise random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates code in the form of instructions or data structures and that can be accessed, read, and/or executed by a computer.

The instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated software modules or hardware modules configured or adapted to perform the techniques of this disclosure.

If implemented in hardware, one or more aspects of this disclosure may be directed to a circuit, such as an integrated circuit, chipset, ASIC, FPGA, logic, or various combinations thereof configured or adapted to perform one or more of the techniques described herein. The circuit may include both the processor and one or more hardware units, as described herein, in an integrated circuit or chipset.

It should also be noted that a person having ordinary skill in the art will recognize that a circuit may implement some or all of the functions described above. There may be one circuit that implements all the functions, or there may also be multiple sections of a circuit that implement the functions. With current mobile platform technologies, an integrated circuit may comprise at least one DSP, and at least one Advanced Reduced Instruction Set Computer (RISC) Machine (ARM) processor to control and/or communicate to DSP or DSPs. Furthermore, a circuit may be designed or implemented in several sections, and in some cases, sections may be re-used to perform the different functions described in this disclosure.

Various examples have been described. These and other examples are within the scope of the following claims.

The invention claimed is:

1. A method comprising:

generating a linked list of voice indicators, wherein each of the voice indicators in the linked list indicates a Musical Instrument Digital Interface (MIDI) voice for a MIDI frame by specifying an index value that defines a memory location that stores a voice parameter set that defines the MIDI voice, wherein the MIDI voices indicated by the voice indicators in the linked list are those MIDI voices that have a greatest acoustical significance during the MIDI frame;

and generating digital waveforms for the MIDI voices indicated by the voice indicators in the linked list.

2. The method of claim 1, wherein generating a linked list of voice indicators comprises inserting a voice indicator that indicates a MIDI voice into the linked list.

3. The method of claim 1, wherein generating the linked list of voice indicators comprises:

creating a new voice indicator that indicates the MIDI voice when the linked list does not include the voice indicator that indicates the MIDI voice.

4. The method of claim 1, wherein generating a linked list of voice indicators comprises removing a voice indicator from the linked list when a tally of voice indicators in the linked list exceeds a maximum.

5. The method of claim 4, wherein removing a voice indicator from the linked list comprises:

identifying a voice indicator in the linked list that indicates a MIDI voice that is the least acoustically significant in the MIDI frame among MIDI voices indicated by voice indicators in the linked list; and removing the identified voice indicator from the linked list.

6. The method of claim 1, wherein generating a linked list comprises generating a linked list in which the voice indicators in the linked list are arranged in a sequence according to acoustical significance of MIDI voices indicated by the voice indicators.

7. The method of claim 6, wherein generating a linked list comprises:

comparing an acoustical significance of a MIDI voice indicated by a first voice indicator with an acoustical significance of a MIDI voice indicated by a second voice indicator; and inserting the first voice indicator into the linked list in front of the second voice indicator when the acoustical significance of the MIDI voice indicated by the first voice indicator is greater than the acoustical significance of the MIDI voice indicated by the second voice indicator.

8. The method of claim 6, wherein generating a digital waveform for each MIDI voice indicated by a voice indicator in the linked list comprises generating digital waveforms for the MIDI voices indicated by the voice indicators in the linked list according to the sequence of the voice indicators in the linked list.

9. The method of claim 1, wherein each of the voice indicators identifies a plurality of memory locations that store voice parameter sets that define MIDI voices.

10. The method of claim 1, wherein generating a linked list of voice indicators comprises setting a memory address in each voice indicator in the linked list, other than a last voice indicator in the linked list, such that each voice indicator in the linked list includes a memory address of a next voice indicator in the linked list.

11. The method of claim 1, wherein generating a digital waveform comprises:

obtaining a memory address for a memory location that stores a voice parameter set that defines a MIDI voice indicated by a voice indicator in the linked list; and retrieving a parameter in the voice parameter set using the memory address.

12. The method of claim 11, wherein obtaining a memory address comprises:

calculating an intermediate value by multiplying an index value specified by one of the voice indicators by a size of a voice parameter set; and adding a base address to the intermediate value to obtain a memory address of a memory location that stores a voice parameter set that defines a MIDI voice.

13. The method of claim 12, wherein obtaining a memory address comprises using a memory address specified by the voice indicator.

14. The method of claim 1, wherein generating a digital waveform comprises generating, in a parallel, a digital waveform for a first one of the MIDI voices indicated by a voice indicator in the linked list and a digital waveform for a second one of the MIDI voices indicated by a different voice indicator in the linked list.

15. The method of claim 14, wherein generating a digital waveform further comprises summing digital waveforms for each of the MIDI voices indicated by voice indicators in the linked list to create an overall waveform for the MIDI frame.

16. The method of claim 1, wherein generating a digital waveform comprises executing a software program with a processing element to generate a digital waveform for one of the MIDI voices indicated by a voice indicator in the linked list, wherein the software program is composed of program instructions from an instruction set that is customized to generate MIDI voices.

17. The method of claim 16, wherein executing the software program comprises:

executing an instruction in the software program, wherein executing an instruction in the software program comprises:

reading the instruction with a control unit;

selecting an operation based on a set of voice parameters that define the current MIDI voice; and outputting control signals to cause the selected operation to be performed.

18. The method of claim 1, wherein generating a digital waveform comprises:

fetching a waveform from a memory location specified by a voice parameter set of the MIDI voice; and applying an arithmetic operation to the fetched waveform using information in the voice parameter set of the MIDI voice to generate a waveform for the MIDI voice for the MIDI frame.

19. The method of claim 1, wherein the voice parameter sets remain in the memory locations that store the voice parameters sets during generation of the linked list and during generation of a digital waveform for each MIDI voice.

20. A device comprising:

a memory unit that stores voice parameter sets, wherein each of the voice parameter sets defines a Musical Instrument Digital Interface (MIDI) voice;

a processor that generates a linked list of voice indicators, wherein each of the voice indicators in the linked list indicates a MIDI voice by specifying an index value that defines a memory location in the memory unit that stores one of the voice parameter sets that defines the MIDI voice, and wherein MIDI voices indicated by the voice indicators in the linked list are those MIDI voices that have a greatest acoustical significance during the MIDI frame; and a plurality of processing elements that generate digital waveforms for the MIDI voices indicated by the voice indicators in the linked list.

21. The device of claim 20, wherein the processor comprises a digital signal processor.

22. The device of claim 20, wherein the processor generates the linked list at least in part by inserting a voice indicator that indicates a MIDI voice into the linked list.

23. The device of claim 20, wherein the processor generates the linked list at least in part by creating a new voice indicator that indicates the MIDI voice when the linked list does not include the voice indicator that indicates the MIDI voice.

24. The device of claim 20, wherein the processor generates the linked list at least in part by removing a voice indicator from the linked list when a tally of voice indicators in the linked list exceeds a maximum.

25. The device of claim 24, wherein the processor generates the linked list at least in part by identifying a voice indicator in the linked list that indicates a MIDI voice that is least acoustically significant in the MIDI frame among MIDI voice indicated by voice indicators in the linked list and by removing the identified voice indicator from the linked list.

26. The device of claim 20, wherein the voice indicators in the generated linked list are arranged in a sequence according to acoustical significance of MIDI voices indicated by the voice indicators in the linked list.

27. The device of claim 26, wherein the processing elements generate the digital waveforms for MIDI voices indicated by voice indicators in the linked list according to the sequence of the voice indicators in the linked list.

28. The device of claim 20, wherein each of the voice indicators identifies a plurality of memory locations in the memory unit that store voice parameter sets that define MIDI voices.

29. The device of claim 20, wherein the electronic device further comprises:

a voice parameter set memory unit for each of the processing elements; and a distribution module that obtains a memory address of a memory location in the memory unit that stores a voice parameter set that defines a MIDI voice indicated by a voice indicator in the linked list and to use the obtained memory address to retrieve a parameter of the voice parameter set and to store the parameter of the voice parameter set into the voice parameter set memory unit for one of the processing elements.

30. The device of claim 20, wherein the processing elements generate digital waveforms for the MIDI voices in parallel.

31. The device of claim 20, wherein the electronic device further comprises a summing buffer that sums digital waveforms for each of the MIDI voices indicated by voice indicators in the linked list to create an overall waveform for the MIDI frame.

32. A computer-readable medium comprising instructions, the instructions causing a programmable processor to:

generate a linked list of voice indicators, wherein each of the voice indicators in the linked list indicates a Musical Instrument Digital Interface (MIDI) voice for a MIDI frame by specifying an index value that defines a memory location that stores a voice parameter set that defines the MIDI voice, wherein the MIDI voices indicated by the voice indicators in the linked list are those MIDI voices that have a greatest acoustical significance during the MIDI frame;

and generate digital waveforms for the MIDI voices indicated by the voice indicators in the linked list.

33. The computer-readable medium of claim 32, wherein the instructions cause the programmable processor to generate a linked list of voice indicators by causing the programmable processor to:

create a new voice indicator that indicates the MIDI voice when the linked list does not include the voice indicator that indicates the MIDI voice.

34. The computer-readable medium of claim 32, wherein the instructions cause the programmable processor to generate a linked list of voice indicators by causing the programmable processor to generate a linked list in which the voice indicators in the linked list are arranged in a sequence according to acoustical significance of MIDI voices indicated by the voice indicators.

35. A device comprising:

means for storing voice parameter sets, wherein each of the voice parameter sets defines a Musical Instrument Digital Interface (MIDI) voice;

means for generating a linked list of voice indicators, wherein each of the voice indicators in the linked list indicates a MIDI voice by specifying an index value that defines a memory location in the memory unit that stores one of the voice parameter sets the defines the MIDI voice, and wherein MIDI voices indicated by the voice indicators in the linked list are those MIDI voices that have the greatest acoustical significance during the MIDI during the MIDI frame; and a plurality of processing means for generating digital waveforms for MIDI voices indicated by the voice indicators in the linked list.

36. The device of claim 35, wherein the means for generating a linked list of voice indicators generates the linked list at least in part by creating a new voice indicator that indicates the MIDI voice when the linked list does not include the voice indicator that indicates the MIDI voice.

37. The device of claim 35, wherein the means for generating a linked list of voice indicators generates the linked list such that voice indicators in the linked list are arranged in a sequence according to acoustical significance of MIDI voices indicated by the voice indicators in the linked list.

38. A circuit configured to:

generate a linked list of voice indicators, wherein each of the voice indicators in the linked list indicates a Musical Instrument Digital Interface (MIDI) voice for a MIDI frame by specifying an index value that defines a memory location that stores a voice parameter set that defines the MIDI voice, wherein the MIDI voices indicated by the voice indicators in the linked list are those MIDI voices that have a greatest acoustical significance during the MIDI frame; and generate digital waveforms for the MIDI voices indicated by the voice indicators in the linked list.

39. The circuit of claim 38, wherein the circuit is configured to:

create a new voice indicator that indicates the MIDI voice when the linked list does not include the voice indicator that indicates the MIDI voice.

40. The circuit of claim 38, wherein the circuit is configured to generate a linked list in which the voice indicators in the linked list are arranged in a sequence according to acoustical significance of MIDI voices indicated by the voice indicators.

* * * * *

UNITED STATES PATENT AND TRADEMARK OFFICE

CERTIFICATE OF CORRECTION

PATENT NO. : 7,718,882 B2
APPLICATION NO. : 12/042121
DATED : May 18, 2010
INVENTOR(S) : Devalapalli et al.

It is certified that error appears in the above-identified patent and that said Letters Patent is hereby corrected as shown below:

Title page, Item (75) Inventor's address: "Placentia, CA (US)" to read as --San Diego, CA (US)--

Column 34, line 63, claim 33: "in a parallel" to read as --in parallel--

Column 35, line 33, claim 14: "parameters" to read as --parameter--

Column 36, line 3, claim 25: "voice" to read as --voices--

Column 37, line 9, claim 35: "the defines" to read as --that defines--

Column 37, line 14, claim 35: delete "during the MIDI"

Signed and Sealed this
Twenty-eighth Day of June, 2011

David J. Kappos

David J. Kappos
*Director of the United States Patent and Trademark Office*